US006776361B1

(12) United States Patent
Watanabe et al.

(10) Patent No.: US 6,776,361 B1
(45) Date of Patent: Aug. 17, 2004

(54) POWDER MATERIAL SPRAYING DEVICE

(75) Inventors: Yasushi Watanabe, Shizuoka (JP); Kimiaki Hayakawa, Shizuoka (JP); Kiyoshi Morimoto, Shizuoka (JP)

(73) Assignee: Kyowa Hakko Kogyo Co., Ltd., Tokyo (JP)

( * ) Notice: Subject to any disclaimer, the term of this patent is extended or adjusted under 35 U.S.C. 154(b) by 0 days.

(21) Appl. No.: 10/019,936

(22) PCT Filed: Jul. 5, 2000

(86) PCT No.: PCT/JP00/04462

§ 371 (c)(1),
(2), (4) Date: Apr. 24, 2002

(87) PCT Pub. No.: WO01/03849

PCT Pub. Date: Jan. 18, 2001

(30) Foreign Application Priority Data

Jul. 8, 1999 (JP) ..... 11-194264

(51) Int. Cl.[7] ..... A02C 15/04; A02C 3/06; A02C 15/00; A02C 19/00; A02C 7/00

(52) U.S. Cl. ..... 239/654; 239/659; 239/102.1; 239/143; 222/195; 222/494

(58) Field of Search ..... 222/195, 494, 222/61, 185.1, 406; 239/650, 654, 659, 102.1, 101, 124, 142–143, 398, 533.1, 533.13, 533.14, 546, 596, 600, 602, DIG. 12

(56) References Cited

U.S. PATENT DOCUMENTS 3,501,097 A * 3/1970 Daley ..... 239/85
4,462,547 A * 7/1984 Metz ..... 239/130
5,400,921 A * 3/1995 Smith et al. ..... 222/1
5,407,339 A * 4/1995 Fehlhafer ..... 425/106
5,700,492 A * 12/1997 Morimoto et al. ..... 425/100
5,992,772 A * 11/1999 Hibner et al. ..... 239/704
5,996,902 A * 12/1999 Morimoto et al. ..... 239/4
6,302,573 B1 * 10/2001 Morimoto et al. ..... 366/106
6,464,737 B1 * 10/2002 Morimoto et al. ..... 23/313 FB

FOREIGN PATENT DOCUMENTS

EP 0815931 * 1/1998 ..... B01J/2/00

* cited by examiner

*Primary Examiner*—Michael Mar
*Assistant Examiner*—Darren Gorman
(74) *Attorney, Agent, or Firm*—Fitzpatrick, Cella, Harper & Scinto

(57) ABSTRACT

A powdered material spraying device comprising a quantitative spraying device provided for a material discharge port of the powdered material storage hopper via a material feed valve, a cover being provided for the material feed port of the powdered material storage hopper. The spraying device includes a cylindrical body connected with the material discharge port of the powdered material storage hopper, an elastic membrane with a penetrating aperture provided so as to form a bottom of the cylindrical body at its lower opening end, and a dispersion chamber connected under the lower opening end of the cylindrical body via the elastic membrane. The dispersion chamber has a pulsating vibration air supply port for supplying a positive pulsating vibration air to the dispersion chamber and a discharge port. A bypass pipe is connected between the cylindrical body and the dispersion chamber and the powdered material is sprayed from a tip end of a conduit connected with the discharge port of the dispersion chamber.

10 Claims, 20 Drawing Sheets comparison of spraying amout with/without bypass pipe 35

POWDER MATERIAL SPRAYING DEVICE

TECHNICAL FIELD

The present invention relates to a powdered material spraying device, more particularly to a powdered material spraying device having an elastic membrane with a penetrating aperture, and more specifically to a powdered material spraying device which may improve the discharge property of a powdered material from the penetrating aperture provided for the elastic membrane.

BACKGROUND ART

The inventors of the present invention have already proposed a minute powder spraying device utilizing an elastic membrane with a penetrating aperture in JP-A-8-161553 as powder material spraying means for quantitatively spraying a powdered material.

FIG. 19 shows a diagrammatic configuration of the spraying device. The spraying means 201 is provided for a material discharge port 202*a* of a powdered material storage hopper 202 for storing a powdered material so as to form a bottom of the hopper 202 and is provided with an elastic membrane 232 having a penetrating aperture 232*a* and with a pneumatic transport pipe T. A cover 202*c* is detachably and airtightly provided for a material charge port 202*b* of the material storage hopper 202.

The material discharge port 202*a* of the material storage hopper 202 is connected with the pneumatic transport pipe T so as to interpose the elastic membrane 232 in midstream of the pneumatic transport pipe T.

The penetrating aperture 232*a* provided for the elastic membrane 232 is a slit in this embodiment.

One end Ta of the pneumatic transport pipe T is connected to positive pulsating vibration air generation means 221. When the generation means 221 is driven, the generated positive pulsating vibration air is supplied to the pneumatic transport pipe T from the end Ta.

Next, the operations of the minute powder spraying means 201 will be explained hereinafter.

FIG. 20 is a diagrammatic explanatory view how the elastic membrane 232 of the spraying means 201 operates.

For spraying a fixed amount of powdered material from the other end Tb of the pneumatic transport pipe T by means of the spaying means 201, a powdered material is stored in the material storage hopper 202. Then the cover 202*c* is airtightly attached on the material charge port 202*b* of the powder material storage hopper 202.

Next, a positive pulsating vibration air is supplied to the pneumatic transport pipe T by driving the positive pulsating vibration air generation means 221.

According to the spraying means 201, when the positive pulsating vibration air is supplied to the pneumatic transport pipe T, the pressure in the pneumatic transport pipe T increases at a peak amplitude of the pulsating vibration air, and the elastic membrane 232 is deformed to curve its center upwardly. In this case, the penetrating aperture 232*a* is shaped like a letter V in such a manner that the top is opened seen in section. A part of the powdered material stored in the storage hopper 202 falls in the V-shaped penetrating aperture 232*a* (see FIG. 20*a*).

As the positive pulsating vibration air supplied to the pneumatic transport pipe T is directed to the valley of the amplitude and the pressure in the pneumatic transport pipe T is gradually reduced, the elastic membrane 232 returns to its original shape from the upwardly curved shape because of its restoring force. At the same time the V-shaped aperture 232*a* is returned to its original shape and the powdered material dropped in the V-shaped aperture 232*a* is caught in the aperture 232*a* (see FIG. 20*b*).

Then the positive pulsating vibration air supplied to the pneumatic transport pipe T comes to be its valley of the amplitude and the pressure in the pneumatic transport pipe T is reduced, the elastic membrane 232 is elastically deformed with the center curved downwardly. In this time the penetrating aperture 232*a* forms like a reverse V-shape in such a manner that the lower end is opened seen in section, and the powdered material caught in the aperture 232*a* falls in the pneumatic transport pipe T (see FIG. 20*c*).

The powdered material dropped in the pneumatic transport pipe T is mixed with and dispersed in the positive pulsating vibration air supplied in the pipe T.

The dropped material in the pipe T is pneumatically transported to the other end Tb of the pipe T to be sprayed with the positive pulsating vibration air therefrom.

The vibration of the elastic membrane 232 of the minute powder spraying means 201 depends on the positive pulsating vibration air supplied in the pipe T. The amount of powdered material supplied via the penetrating aperture 232*a* to the pneumatic transport pipe T is primary determined by the vibration of the elastic membrane 232. Therefore, a fixed amount of powdered material is discharged to the pneumatic transport pipe T as long as the positive pulsating vibration air supplied to the pneumatic transport pipe T is constant.

A positive pulsating vibration air, not a constant air flow, is designed to be supplied to the pneumatic transport pipe T. Therefore, the powdered material in the pneumatic transport pipe T doesn't cause accumulation and pinhole, which have been seen when a powdered material is pneumatically transported at a steady air flow in the pipe T to the other end Tb.

Accordingly, almost all of the powdered material supplied to the pneumatic transport pipe T via the penetrating aperture 232*a* of the elastic membrane 232 is sprayed from the other end Tb of the pneumatic transport pipe T.

The powder material spraying means 201 has a beneficial effect such that a fixed amount of powdered material can be always sprayed from the other end Tb of the pneumatic transport pipe T as long as the positive pulsating vibration air supplied in the pipe T is constant. Furthermore, the spraying means 201 has a beneficial effect wherein the concentration of the powdered material sprayed from the other end Tb of the pneumatic transport pipe T can be easily changed because it can be varied depending on the positive pulsating vibration air supplied from the one end Ta of the pipe T.

However according to this spraying means 201, air is fed in the powdered material storage hopper 202 from the pneumatic transport pipe T through the penetrating aperture 232*a* of the elastic membrane 232, and the powdered material is discharged from the storage hopper 202 through the penetrating aperture 232*a* of the elastic membrane 232.

The air flow to the storage hopper 202 from the pneumatic transport pipe T and the discharge of the powdered material in the pneumatic transport pipe T from the hopper 202, both of which are done via the penetrating aperture 232*a* of the elastic membrane 232, utilize reverse air flows respectively. The pressure in the pneumatic transport pipe T is higher than that in the storage hopper 202 at a time of driving. The elastic membrane 232 is apt to expand into a direction of the storage hopper 202 (upwardly) till a balanced condition immediately after driving. Therefore, the amount of the powdered material discharged from the penetrating aperture 232*a* of the elastic membrane 232 is reduced so that the amount of material sprayed from the other end Tb of the pneumatic transport pipe T is subject to be reduced.

It has been found that when the charge amount of powdered material in the storage hopper 202 is varied, the amount of powdered material sprayed from the other end Tb of the pneumatic transport pipe T has been varied, thereby deteriorating its quantitativeness.

According to the minute powder spraying means 201, the quantitativeness of powdered material sprayed from the other end Tb of the pneumatic transport pipe T depends on the vertical vibration pattern of the elastic membrane 232. Therefore, even though the positive pulsating vibration air is accurately generated, the elastic membrane 232 doesn't execute an accurate reproductive movement for the positive pulsating vibration air in case that the elastic membrane 232 having the penetrating aperture 232*a* provided at the discharge port 202*a* of the storage hopper 202 isn't uniformly stretched with an appropriate tensile, thereby deteriorating the quantitativeness of the powdered material sprayed from the other end Tb of the pneumatic transport pipe T.

For ensuring the quantitativeness of powdered material sprayed from the other end Tb of the pipe T of the spraying means 201, a problem exists because functions of the means 201 can't be brought out well when the elastic membrane 232 is slackly attached.

Furthermore, if such means 201 is used for a long time, the elastic membrane 232 gradually comes to be slack because of the vibration and the function of the means 201 is deteriorated with time.

When the powdered material stored in the storage hopper 202 is directly discharged in the pneumatic transport pipe T via the penetrating aperture 232*a* of the elastic membrane 232, if large particles of powdered or granular material are contained in the stored material in the hopper 202, such large particles are pneumatically transported in the transport pipe T and are sprayed from the other end Tb.

There remains a room of improvement so as not to spray such large particles from the other end Tb of the pneumatic transport pipe T while keeping the quantitativeness of powdered material sprayed from the other end Tb of the pipe T in order to utilize the means 201 as a lubricant spray device for spraying a lubricant on each surface of upper punches, lower punches, and dies of an external lubrication type tabletting machine which requires the quantitativeness and evenness of the lubricant particle size.

DISCLOSURE OF THE INVENTION

The present invention has been proposed in order to solve the above-mentioned problems and to provide a powdered material spraying device superior in the discharge property and quantitativeness of the powdered material executed by means of a penetrating aperture 232*a* of an elastic membrane 232. The present invention has also been proposed to provide a powdered material spraying device wherein an elastic membrane can be equipped at a material discharge port of a powdered material storage hopper easily, at an appropriate tensile strength, and uniformly. Furthermore, the present invention has been proposed to provide a powdered material spraying device which is more improved 60 as not to spray large particles of the powdered material while keeping the quantitativeness of powdered material sprayed from one end Tb of a pneumatic transport pipe T.

According to the powdered material spraying device as set forth in claim 1, powdered material spraying device includes; a powdered material storage hopper for storing a powdered material, a quantitative spraying device provided for a material discharge port of the powdered material storage hopper via a material feed valve. A cover is detachably and airtightly provided for the material discharge port of the powdered material storage hopper. The quantitative spraying device includes a cylindrical body with openings at the top and the end respectively, the cylindrical body being airtightly connected with the material discharge port of the powdered material storage hopper, an elastic membrane with a penetrating aperture provided so as to form a bottom of the cylindrical body at its lower opening end, and a dispersion chamber connected under the lower opening end of the cylindrical body via the elastic membrane. The dispersion chamber includes a pulsating vibration air supply port for supplying a positive pulsating vibration air therein, and a discharge port connected with a conduit for pneumatically transporting the powdered material to a desired place by means of the positive pulsating vibration air. The powdered material is discharged into the dispersion chamber via the penetrating aperture when the elastic membrane is vibrated up and down by the positive pulsating vibration air supplied to the dispersion chamber from the pulsating vibration air supply port and is mixed with the positive pulsating vibration air. A bypass pipe is connected between the cylindrical body and the dispersion chamber.

According to this powdered material spraying device, an air communication passage between the cylindrical body and the dispersion chamber is comprised of two lines: the penetrating aperture provided for the elastic membrane and the bypass pipe by connecting the bypass pipe between the cylindrical body and the dispersion chamber.

It isn't sure at the present moment how the installation of the bypass pipe other than the penetrating aperture of the elastic membrane as an air passage between the cylindrical body and the dispersion chamber acts on improving the discharge efficiency of the powdered material into the dispersion chamber which is executed through the penetrating aperture of the elastic membrane. However, the inventors of the present invention think that the bypass pipe contributes to improve the discharge efficiency of the powdered material in the dispersion chamber because of the following operational principles.

When the air communication passage between the cylindrical body and the dispersion chamber is the penetrating aperture only, an air flow to equalize the pressure in the cylindrical body and that in the dispersion chamber is caused only via the penetrating aperture.

A positive pulsating vibration air is then supplied to the dispersion chamber, air flows from the dispersion chamber to the cylindrical body through the aperture when the pressure in the dispersion chamber is higher than that in the cylindrical body. If the pressure in the dispersion chamber is lower than that in the cylindrical body, air flows from the cylindrical body to the dispersion chamber through the penetrating aperture.

Accordingly, it takes a long time to balance the pressures in the cylindrical body and in the dispersion chamber and the elastic membrane is apt to expand into the cylindrical body (upwardly). As a result, the vibration of the positive pulsating vibration air tends to be smaller so that the expansion and contraction of the penetrating aperture of the elastic membrane gets small. The amount of discharged powdered material via the penetrating aperture may be reduced immediately after driving the device till the pressures above and under the elastic membrane are balanced.

Contrary in the present invention, the air communication passage has two lines consisting the penetrating aperture of the elastic membrane and the bypass pipe so that the air can flow between the cylindrical body and the dispersion chamber via an available line.

When the positive pulsating vibration air is supplied to the dispersion chamber, the pressure in the cylindrical body and that in the dispersion chamber are balanced at once, enabling the elastic membrane to vibrate up and down with substantially an equal amplitude with its original extended position as a neutral position, thus achieving the reproducibility and responsibility of the vibration.

As a result, it is considered that the discharge of the powdered material via the penetrating aperture of the elastic membrane can be executed suitably.

According to the powdered material spraying device as set forth in claim 2, the elastic membrane is provided by means of an elastic membrane installation device between a lower part of the cylindrical body and an upper part of the dispersion chamber. The elastic membrane installation device comprises a pedestal with a hollow part, a push-up member with a hollow part provided so as to rise on a surface of the pedestal and a presser member with a hollow part which is a little larger than an outer circumference of the push-up member. The pedestal has a V-groove outside of the hollow part to be the outside of the outer circumference of the push-up member so as to annularly surround the hollow part of the pedestal and the presser member has an annular V-shaped projection on its surface casing the pedestal so as to be incorporated with the V-groove provided on the surface of the pedestal. The push-up member is placed on the surface of the pedestal, and then the elastic member is placed thereon. The presser member is fastened against the pedestal so as to cover both the push-up member and the elastic membrane, therefore the elastic membrane is kept to be extended from its center to its periphery by pushing up the elastic membrane into the presser member by means of the push-up member. Thus extended periphery of the elastic membrane by the push-up member is held between a periphery (inclined plane) of the push-up member and a plane forming the hollow of the presser member and also between the V-groove on the surface of the pedestal and the V-shaped projection on the surface of the presser member facing the pedestal. The bottom of the pedestal is provided above the dispersion chamber and under the presser member is provided at the lower end of the cylindrical body.

When the elastic membrane is placed on the push-up member on the pedestal of the elastic membrane installation means and is fastened by the presser member to the pedestal, the elastic membrane is pushed upwardly against the presser member by the push-up member. As a result, the elastic membrane is extended from its center to its periphery by being pushed upwardly into the presser member.

At first, the elastic membrane extended by the push-up member is inserted between the V-groove on the pedestal surface and the V-shaped projection of the surface of the presser member facing the pedestal via a space between the periphery (inclined surface) of the push-up member and a surface (inner surface) forming the hollow part of the presser member.

As the presser member is further fastened against the pedestal, the elastic membrane is held between the periphery (inclined surface) of the push-up member and the surface (inner surface) forming the hollow of the presser member while being pushed upwardly to the presser member with the push-up member. The inserted portion between the V-groove on the pedestal surface and the V-shaped projection on the presser member's surface facing the pedestal when the elastic member is extended from its center to its periphery by being pushed up into the presser member by the push-up member is held between the V-groove and the V-shaped projection.

According to the elastic membrane installation means, the elastic membrane can be strained by a simple operation such that the elastic membrane is placed on the push-up member on the pedestal and the presser member is fastened to the pedestal.

The push-up member of the powdered material spraying device of the present invention may have an inclined plane extending from top to bottom at its periphery seen in section.

As the inclined plane is provided for the periphery of the push-up member, the extended portion from its center to its periphery of the elastic membrane pushed up to the presser member is easily moved between the V-groove formed like a ring on the pedestal and the V-shaped projection formed like a ring on the surface of the presser member facing the pedestal.

As mentioned above, the elastic membrane can be strained by a simple operation such that the elastic membrane is placed on the push-up member on the pedestal and the presser member is fastened to the pedestal.

Furthermore, as the presser member is further fastened to the pedestal, the space between the inclined plane at the periphery of the push-up member and the inner surface of the hollow part of the presser member is gradually narrowed. Therefore, the elastic membrane is tightly held between the periphery (inclined plane) of the push-up member and the inner surface of the hollow of the presser member so that the elastic membrane doesn't get slack after the presser member is fastened to the pedestal.

Accordingly, if the elastic membrane is stretched with the elastic membrane installation means when a diaphragm is stretched for an instrument or an elastic membrane of a powdered material spraying device is stretched, the elastic membrane doesn't get slack during operation, enabling the device to keep an accurate operation for a long time.

The pulsating vibration air supply port of the powdered material spraying device of the present invention may be provided at the lower part of the dispersion chamber in a substantially tangential direction against an internal circumference of the dispersion chamber, and the discharge port may be provided at the upper part of the dispersion chamber in a substantially tangential direction against the internal circumference of the dispersion chamber.

According to the powdered material spraying device, a positive pulsating vibration air is introduced from the lower part of the dispersion chamber, that is approximately from a tangential direction and is discharged from the upper part of the dispersion chamber, that is approximately into a tangential direction. The positive pulsating vibration air is swirled like a whirlpool from bottom to top in the dispersion chamber.

The dispersion chamber has a particle size classification function like a cyclone by means of the positive pulsating vibration air swirling upwardly in the dispersion chamber.

Therefore, if large agglomerated particles of the powdered material are discharged in the dispersion chamber via the penetrating aperture of the elastic membrane, they keep swirling in the bottom of the dispersion chamber so that such large particles aren't sprayed from the other end of the pipe.

Such a powdered material spraying device can spray a quantitative amount of powdered material with even particle size from the other end of the pipe.

Furthermore, the large particles are caught in the swirling flow of the positive pulsating vibration air in the dispersion chamber so as to be pulverized into smaller particles. Thus pulverized particles into a predetermined particle size are discharged outside of the dispersion chamber riding the swirling flow of the positive pulsating vibration air so that the powdered material with a large particle size is hardly accumulated in the dispersion chamber.

BRIEF DESCRIPTION OF DRAWINGS

FIG. 6 is a plane view showing where a pulsating vibration air supply port of a dispersion chamber is positioned when the dispersion chamber of the powdered material spraying device of FIG. 1 is seen two-dimensionally.

FIG. 7 is an explanatory view diagrammatically showing where a pulsating vibration air supply port and a discharge port are provided for the dispersion chamber when the powdered material spraying device of FIG. 1 is seen two-dimensionally.

BEST MODE FOR CARRYING OUT THE INVENTION

Figure 1:
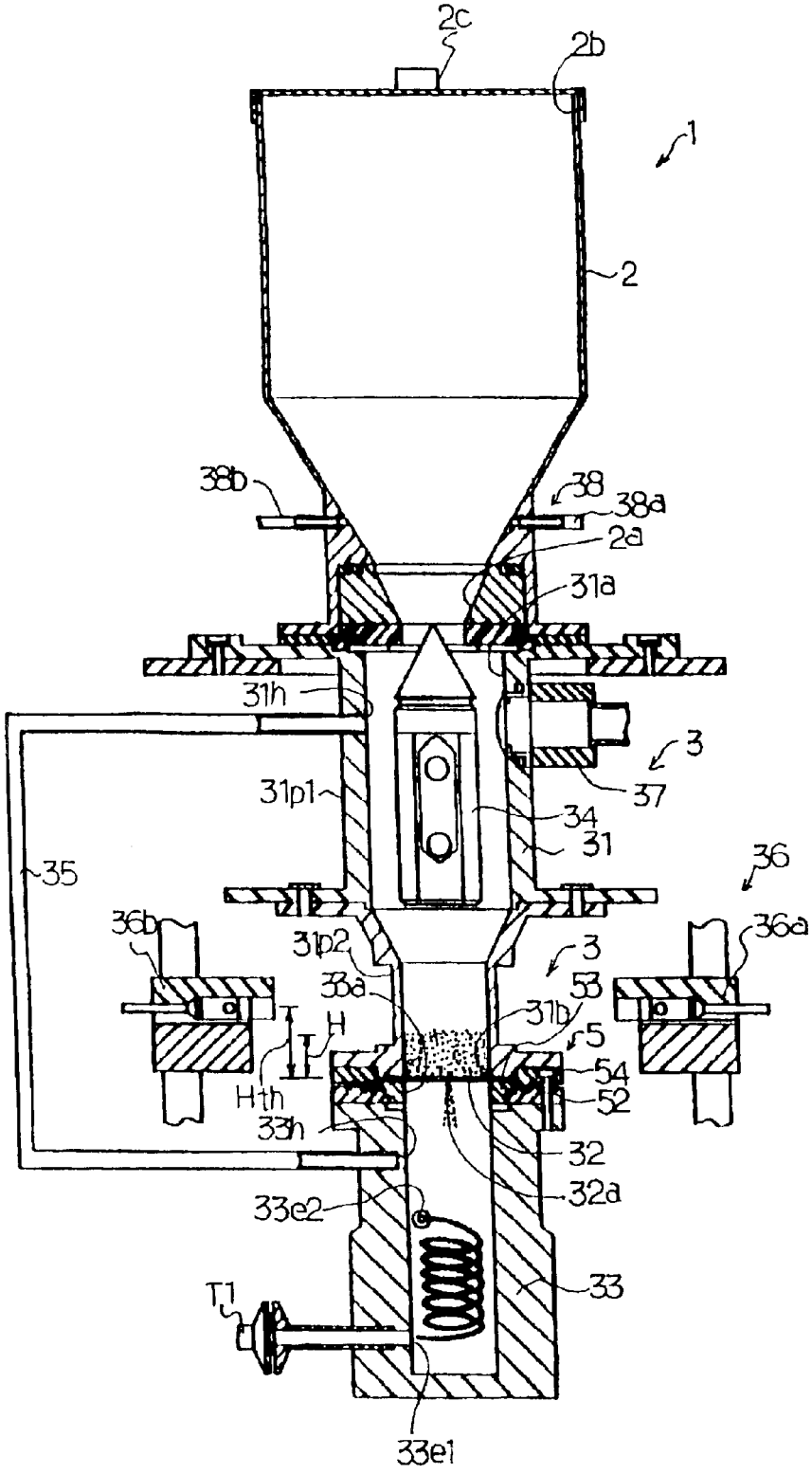
FIG. 1 shows a diagrammatic configuration of a powdered material spraying device of the present invention.

FIG. 1 shows a diagrammatic configuration of a powdered material spraying device of the present invention.

A powdered material spray device 1 is provided with a powdered material storage hopper 2 for storing powdered material and quantitative spraying device 3.

The quantitative spraying device 3 is attached to a material discharge port 2*a* of the powdered material storage hopper 2 via a material feed valve 34.

A cover 2*c* is detachably and airtightly provided for a material feed port 2*b* of the powdered material storage hopper 2.

The quantitative spraying device 3 has openings 31*a*, 31*b* at the top and bottom, a cylindrical body 31 airtightly connected to the material discharge port 2*a* of the powdered material storage hopper 2, an elastic membrane 32 provided so as to form the bottom of the cylindrical body 31 at the lower opening 31*b*, and a dispersion chamber 33 airtightly connected to the lower opening 31*b* of the cylindrical body 31 via the elastic membrane 32.

Figure 2:
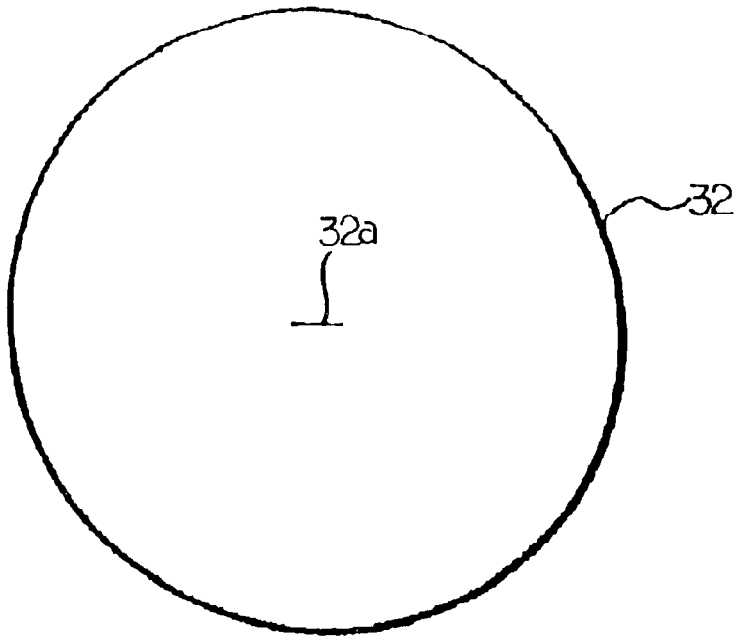
FIG. 2 is a diagrammatic plane view of an elastic membrane used for the powdered material spraying device of FIG. 1.

FIG. 2 is a diagrammatic plane view of the elastic membrane 32.

A penetrating aperture 32*a* is formed on the elastic membrane 32.

In this embodiment, the penetrating aperture 32*a* is like a slit provided at the center of the elastic membrane 32.

The dispersion chamber 33 has a pulsating vibration air supply port 33*e*1 and a discharge port 33*e*2 for supplying and discharging a positive pulsating vibration air to and from the dispersion chamber 33.

An air transport pipe (for example, see an air transport pipe T1 shown in FIG. 8) is connected to the pulsating vibration air supply port 33*e*1 so as to supply a positive pulsating vibration air to the dispersion chamber 33 via the air transport pipe.

The discharge port 33*e*2 is connected to one end of a conduit (not shown) and the powdered material mixed and dispersed in the positive pulsating vibration air is sprayed from the other end of the conduit.

Furthermore, a bypass pipe 35 is provided between the cylindrical body 31 and the dispersion chamber 33.

The elastic membrane 32 of this powdered material spraying device is attached between the lower opening 31*b* of the cylindrical body 31 and a top 33*a* of the dispersion chamber 33 by means of elastic membrane installation means 5.

Figure 3:
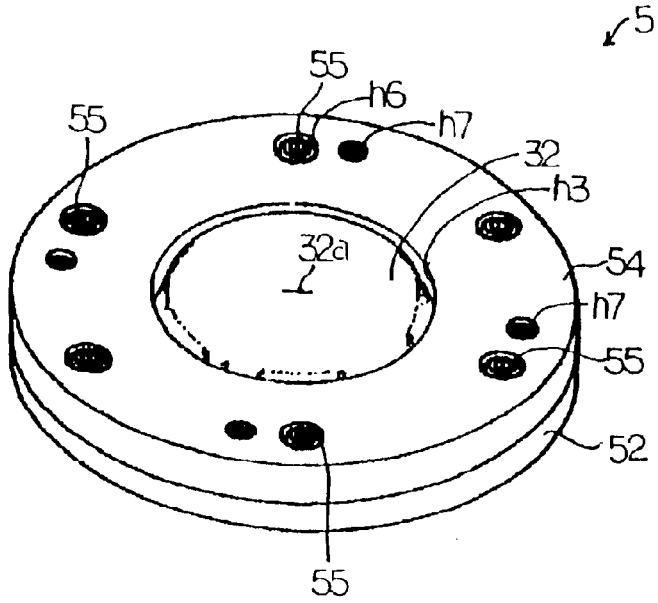
FIG. 3 is a perspective view when an elastic membrane is attached to an elastic membrane installation means of the powdered material spraying device of FIG. 1.
Figure 4:
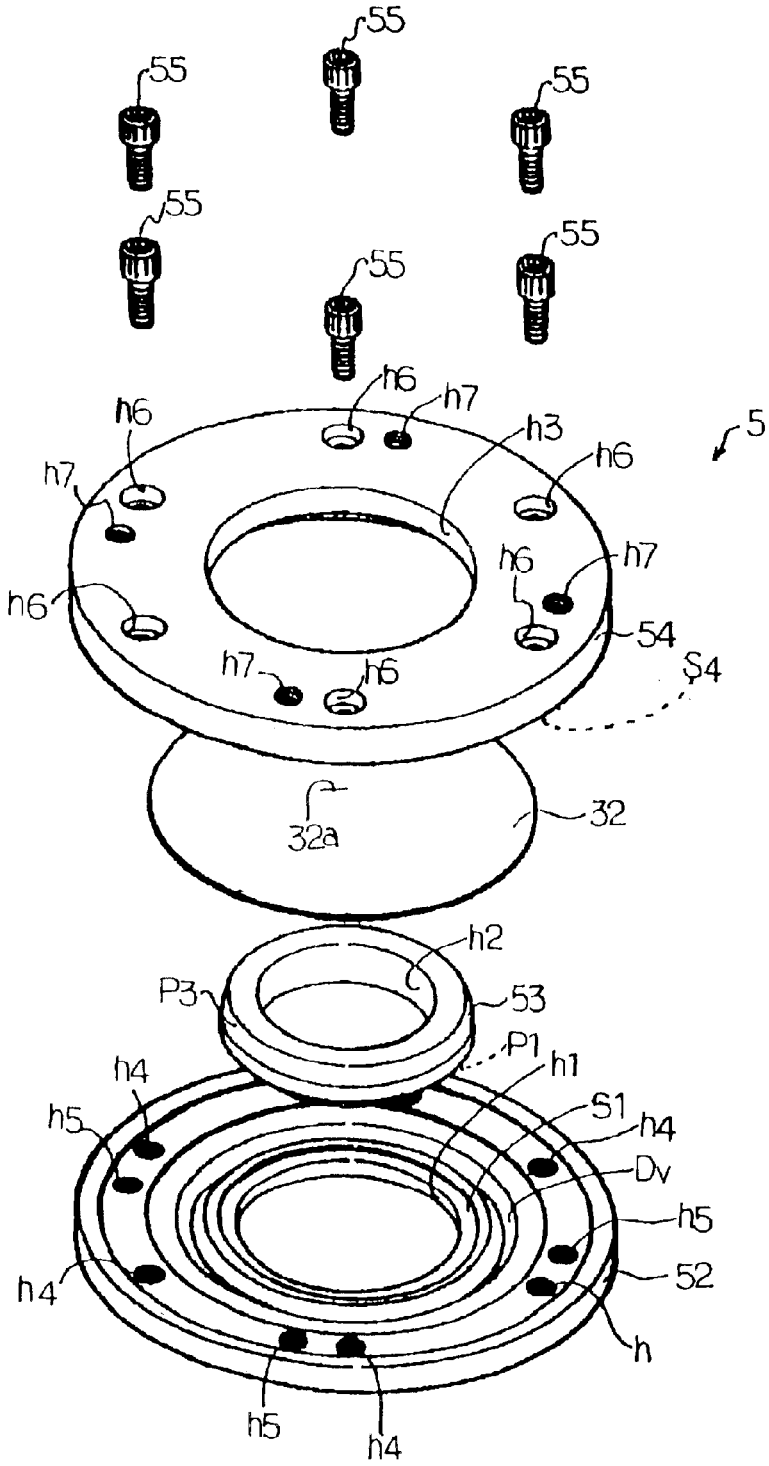
FIG. 4 is an exploded perspective view showing a diagrammatic construction of the elastic membrane installation means of FIG. 3.
Figure 5:
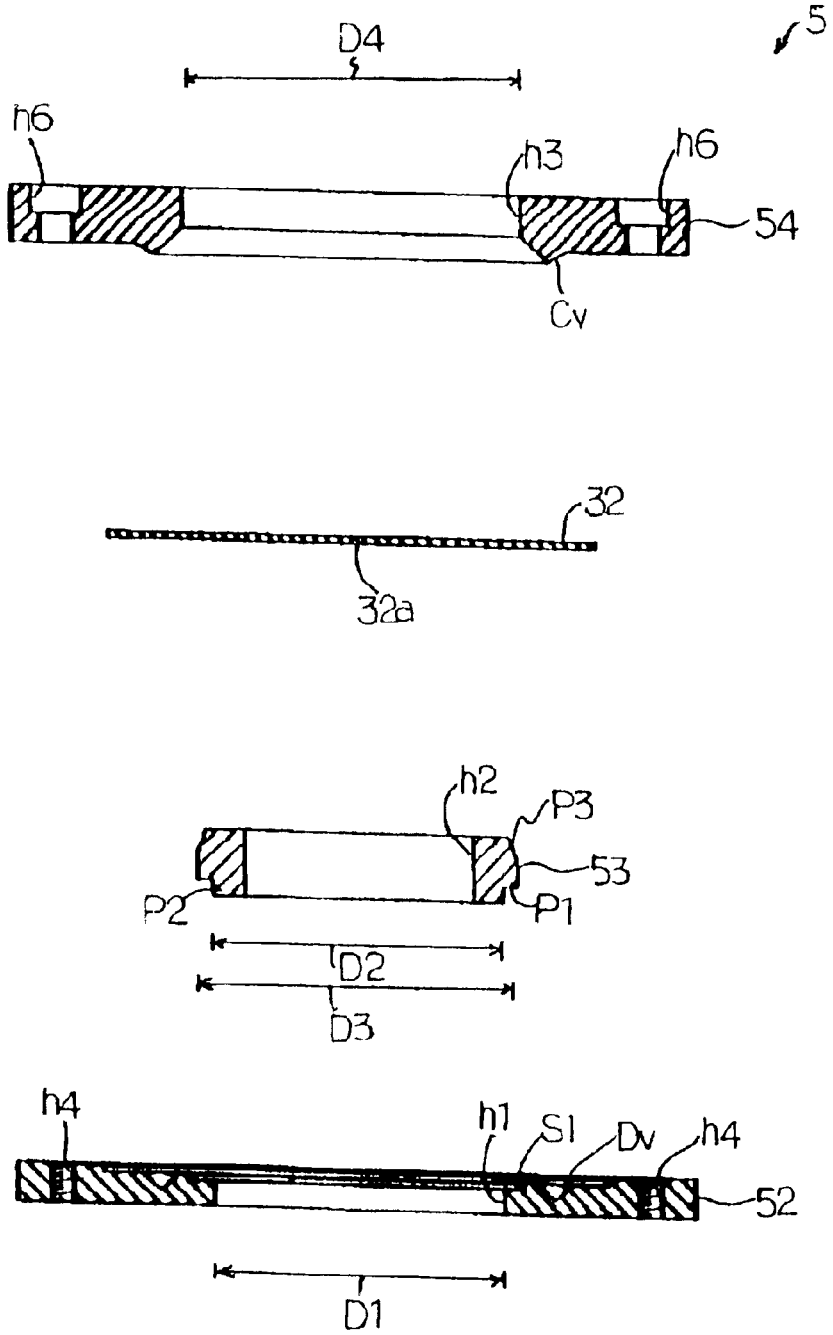
FIG. 5 is a sectional view showing a diagrammatic construction of the elastic membrane installation means of FIG. 3.

FIG. 3 is a perspective view when the elastic membrane 32 is attached on the elastic membrane installation means 5 of the powdered material spraying device of FIG. 1. FIG. 4 is an exploded perspective view showing a diagrammatic construction of the elastic membrane installation means 5 of FIG. 3. FIG. 5 is a sectional view showing a diagrammatic construction of the elastic membrane installation means 5 of FIG. 3.

The elastic membrane installation means 5 has a pedestal 52, a push-up member 53, and a presser member 54.

The pedestal 52 has a hollow h1 the periphery of which has a ring-like platform S1 for placing the push-up member 53. In addition, a V-groove Dv is provided for the pedestal 52 so as to circularly surround the hollow h1.

The push-up member 53 has a hollow h2. A step P1 is provided at a lower part of the push-up member 53 in this embodiment as shown in FIG. 5. When the push-up member 53 is placed on the pedestal 52, the step P1 is designed to be positioned on the platform SI of the pedestal 52.

When the push-up member 53 is placed on the pedestal 52, according to this embodiment, a lower extended part P2 formed so as to be extended downward from the step P1 of the push-up member 53 is designed to be incorporated in the hollow h1 of the pedestal 52. Namely, the lower extended part P2 of the push-up member 53 is precisely processed in such a manner that its outer diameter D2 is almost the same or a little smaller than the inside diameter D1 of the hollow h1 of the pedestal 52.

Furthermore in this embodiment, an inclined plane extending from top to bottom seen in section is provided at the periphery of an upper part of the push-up member 53.

The presser member 54 has a hollow h3. A ring-like V-shaped projection Cv is provided for a surface S4 of the presser member 54 facing the pedestal 52 so as to be incorporated in the V-groove Dv on the surface of the pedestal 52.

The member indicated by a numeral 55 in FIG. 3 and FIG. 4 shows fastening means such as a bolt.

The hole shown as h4 in FIG. 4 is a fixing hole of the fastening means 55 formed on the pedestal 52, and the hole shown as h6 is a fixing hole of the fastening means 55 formed on the presser member 54. The hole shown as h5 in FIG. 4 is a fixing hole of the pedestal 52 for attaching the elastic membrane installation means 5 to a desired device (top 33*a* of the dispersion chamber 33 shown in FIG. 1 in this embodiment) by means of fixing means such as a bolt (not shown). The hole h7 of the presser member 54 is for attaching the elastic membrane installation means 5 to a desired device (lower opening 31*b* of the cylindrical body 31 shown in FIG. 1 in this embodiment).

In this embodiment, the inside diameter D4 of the hollow h3 of the presser member 54 is precisely processed so as to be the same as or a litter larger than the external diameter D3 of the push-up member 53.

Next installation procedures of the elastic membrane installation means 5 on the elastic membrane 32 will be explained hereinafter.

The push-up member 53 is placed on the surface of the pedestal 52 at first for installing the elastic membrane 32 on the elastic membrane installation means 5.

Then, the elastic membrane 32 is placed on the push-up member 53.

The presser member 54 is placed on the push-up member 53 so as to cover both the push-up member 53 and the elastic membrane 32 in such a manner that each fixing hole h4 . . . on the pedestal 52 is aligned with each fixing hole h6 . . . on the presser member 54.

Next, the presser member 54 is fastened to the pedestal 52 by screwing each fastening means such as a bolt 55 . . . into each fastening hole h4 . . . and corresponding each fastening hole h6 . . . .

Accordingly, the elastic membrane 32 is placed on the push-up member 53 on the pedestal 52 of the elastic membrane installation means 5 and the presser member 54 is fastened to the pedestal 52 so that the elastic membrane 32 is pushed upward to the presser member 54 by the push-up member 53.

As a result, the elastic membrane 32 is extended from the center to the periphery by being pushed upward to the presser member 54.

At first, the elastic membrane 32 extended by the push-up member 53 is gradually inserted between the V-groove Dv formed on the pedestal 52 and the V-shaped projection Cv formed on the surface of the presser member 54 facing the pedestal 52 via the space between the inclined plane of the push-up member 53 and the surface (inner surface) forming the hollow h3 of the presser member 54.

Furthermore, as the presser member 54 is fastened to the pedestal 52 by means of the fastening means such as a bolt 55 . . . , the elastic membrane 32 comes to be held between the inclined plane of the push-up member 53 and the inner surface of the hollow h3 of the presser member 54 while being pushed up into the presser member 54 by the push-up member 53. When the elastic membrane 32 is further pushed up into the presser member 54 by the push-up member 53, the extended part from inside to outside of the elastic membrane 32 is held between the V-groove Dv of the pedestal 52 and the V-shaped projection Cv on the surface of the presser member 54 facing the pedestal 52.

In other words, according to the elastic membrane installation means 5, the elastic membrane 32 is placed on the push-up member 53 on the pedestal 52 and the presser member 54 is fastened to the pedestal 52, then the elastic membrane 32 is pushed up to the presser member 54 by the push-up member 53, thereby the elastic membrane 32 is kept being stretched from its inside to outside. Furthermore, the periphery of the elastic membrane 32 extended by the push-up member 53 is held between the V-groove Dv of the pedestal 52 and the V-shaped projection Cv of the presser member 54. As a result, the elastic membrane installation means 5 can keep the elastic membrane 32 stretched only by a simple operation such that the elastic membrane 32 is placed on the push-up member 53 on the pedestal 52 and the presser member 54 is fastened to the pedestal 52.

In addition, the inclined plane P3 enlarging from top to bottom seen in section is provided at the periphery of the push-up member 53.

The inclined plane P3 is an important element of the elastic membrane installation means 5 and is detailed hereinafter.

The inclined plane P3 which is enlarged from top to bottom when seen in section is provided for the periphery of the push-up member 53 of the elastic membrane installation means 5. Therefore, the extended part of the elastic membrane 32 from inside to outside by being pushed up into the presser member 54 is easily moved between the V-groove Dv annularly formed on the pedestal 52 and the V-shaped projection Cv annularly formed on the surface of the presser member 54 facing the pedestal 52.

More specifically, when the external diameter of the inclined plane P3 of the push-up member 53 is substantially smaller than the inner diameter D4 of the hollow h3 of the presser member 54, there is an adequate space between the inclined plane P3 of the push-up member 53 and the surface forming the hollow h3 of the presser member 54, thereby the extended part of the elastic membrane 32 from inside to outside by the push-up member 53 being easily guided to the V-groove Dv annularly provided on the surface of the pedestal 52.

The inclined plane P3 of the periphery of the push-up member 53 is designed so as to be enlarged from top to bottom when seen in section. Therefore, the extended part of the elastic member 32 from inside to outside by the push-up member 53 is guided to the V-groove Dv annularly provided on the pedestal 52 along the surface of the inclined plane P3.

Then the presser member 54 is fastened to the pedestal 52 by screwing each fastening means such as a bolt 55 . . . into each fixing hole h4 . . . and each corresponding fixing hole h6 . . . . Accordingly the external diameter of the inclined plane P3 of the push-up member 53 gets closer to the inner diameter D4 of the hollow h3 of the presser member 54. When the space between the inclined plane P3 of the push-up member 53 and the surface consisting the hollow h3 of the presser member 54 becomes about the thickness (wall thickness) of the elastic membrane 32, the elastic membrane 32 comes to be held between the inclined plane P3 of the push-up member 53 and the surface consisting the hollow h3 of the presser member 54.

From the above-mentioned operations, the elastic membrane 32 is placed on the push-up member 53 on the pedestal 52 of the elastic membrane installation means 5, then the presser member 54 is fastened to the pedestal 52 by means of a simple operation of fixing means such as a bolt 55 . . . , thereby keeping the elastic membrane 32 strained.

When the presser member 54 is fastened to the pedestal 52 by means of the fixing means 55 . . . , the distance between the inclined plane P3 of the periphery of the push-up member 53 and the inner circumference of the hollow h3 of the presser member 54 becomes narrow, and the elastic membrane 32 is tightly held between the periphery (inclined plane) P3 of the push-up member 53 and the inner circumference of the hollow h3 of the presser member 54, preventing the elastic membrane 32 from being slack.

If the elastic membrane 32 is attached on the elastic membrane installation means 5, it is doubly locked between the inclined plane P3 of the push-up member 53 and the surface consisting the hollow h3 of the presser member 54 and between the V-shaped projection Cv annularly provided on the surface of the presser member 54 facing the pedestal 52 and the V-groove Dv annularly provided on the pedestal 52. Thereby, the elastic membrane 32 doesn't slack after the presser member 54 is fastened to the pedestal 52.

Therefore, if the elastic membrane 32 is extended by means of the elastic membrane installation means 5, accurate operations of the powder material spraying device 1 can be kept for a long time because the elastic membrane 32 doesn't get slack during operations.

After the elastic membrane 32 is thus attached on the elastic membrane installation means 5, the presser member 54 thereof on which the elastic membrane 32 is attached is airtightly installed at the lower end 31*b* of the cylindrical body 31 and the pedestal 52 is airtightly provided on the top 33*a* of the dispersion chamber 33.

Referring to FIG. 1 again, the material feed valve 34 is provided on an upper part 31*p*1 of the cylindrical body 31 and is designed to feed a lubricant (powder) stored in the material storage hopper 2 by opening and closing the discharge port 2*a* of the hopper 2 based on the information of a level sensor 36, described later.

A lower part 31*p*2 of the cylindrical body 31 is made of clear resin, specifically a light permeable material such as glass, acrylate resin, polycarbonate resin, and so on.

The level sensor 36 for detecting the amount of lubricant (powder) stored on the elastic membrane 32 is provided for the lower part 31*p*2.

The level sensor 36 is provided with a light emitting element 36*a* for generating light such as infrared rays and visible rays and a light receiving element 36*b* for receiving the light generated from the light emitting element 36*a*. The light emitting element 36*a* and the light receiving element 36*b* are provided to be opposed so as to interpose the lower tube 31*p*2.

The amount of lubricant (powder) stored on the elastic membrane 32 in the lower tube 31*p*2 can be detected at a position Hth (at height where the level sensor 36 is provided above the elastic membrane 32).

Namely, when the amount of lubricant (powder) stored on the elastic membrane 32 in the lower tube 31*p*2 exceeds the position Hth (height where the level sensor 36 is provided above the elastic membrane 32), the light radiated from the light emitting element 36*a* is blocked off by the lubricant (powder) and isn't received by the light receiving element 36*b* (off condition). Then it can be detected that the height H of the lubricant stored on the elastic membrane 32 in the lower tube 31*p*2 exceeds the height Hth (H>Hth).

On the other hand, when the amount of lubricant (powder) stored on the elastic membrane 32 in the lower tube 31*p*2 becomes lower than the position Hth (height where the level sensor 36 is provided above the elastic membrane 32), the light radiated from the light emitting element 36*a* can be received by the light receiving element 36*b* (on condition). Then it can be detected that the height H of the lubricant stored on the elastic membrane 32 in the lower tube 31*p*2 is lower than the height Hth (H<Hth).

In this embodiment the material feed valve 34 moves up and down depending on the detected values of the level sensor 36 so as to open and close the discharge port 2*a* of the material storage hopper 2. More specifically according to the powder material spraying device 1, the light emitting element 36*a* of the level sensor 36 is lighted while the quantitative spraying device 3 is driven. When the light from the light emitting element 36*a* doesn't come to be received in the light receiving element 36*b* (becomes off), the material feed valve 34 is moved up to close the discharge port 2*a* of the material storage hopper 2. When the light from the light emitting element 36*a* is received by the light receiving element 36*b* (becomes on), the material feed valve 34 is moved down to open the discharge port 2*a* of the hopper 2 until the light isn't received by the light receiving element 36*b* (becomes off), thereby approximately the same quantity of lubricant (powder) is always stored on the elastic membrane 32 in the lower tube 31*p*2 while the quantitative spraying device 3 is driven.

In this embodiment, the inner shape of the dispersion chamber 33 is designed to be approximately tubular so as to make a positive pulsating vibration air swirl therein. However, its shape isn't limited as long as a positive pulsating vibration air easily swirls therein.

Furthermore, the pulsating vibration air supply port 33*e*1 is provided at a lower part of the dispersion chamber 33 in approximately a tangential direction of the inside perimeter of the chamber 33.

The discharge port 33*e*2 is provided at an upper part of the dispersion chamber 33 in approximately a tangential direction of the inside perimeter of the chamber 33.

Here the position of the pulsating vibration air supply port 33*e*1 provided for the dispersion chamber 33 is detailed referring to FIG. 6.

Figure 6A:
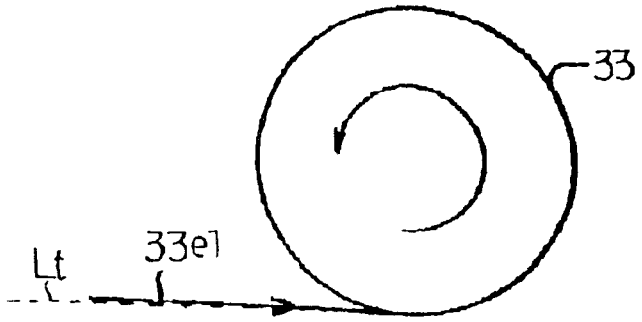
FIG. 6*a* is an explanatory view showing a preferable position for attaching the pulsating vibration air supply port to the dispersion chamber.
Figure 6B:
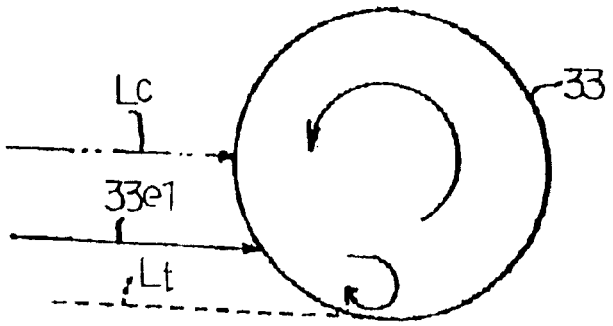
FIG. 6*b* shows a virtual attachable position of the pulsating vibration air supply port to the dispersion chamber.

FIG. 6 is a plane view diagrammatically showing the position of the pulsating vibration air supply port 33*e*1 of the dispersion chamber 33 seen two-dimensionally, FIG. 6*a* is an explanatory view showing a preferable position for providing the pulsating vibration air supply port 33*e*1 to the dispersion chamber 33, and FIG. 6*b* shows a virtual attachable position of the pulsating vibration air supply port 33*e*1 on the dispersion chamber 33.

The curved arrows in FIG. 6*a* and FIG. 6*b* diagrammatically show the directions of the swirling positive pulsating vibration air generated in the dispersion chamber 33.

The pulsating vibration air supply port 33*e*1 is preferably provided in a substantially tangential direction (a direction shown with a dashed line Lt in FIG. 6*a*) against the inside perimeter of the dispersion chamber 33 in order to generate a swirl of the positive pulsating vibration air in the dispersion chamber 33 (see FIG. 6*a*).

However, the supply port 33*e*1 isn't always provided in a tangential direction against the inside perimeter of the chamber 33 as shown in FIG. 6*a*. It may be provided in an equivalent direction to the tangential direction (for example, in a direction parallel to the tangential direction shown with a dashed line Lt in FIG. 6*b*).

If the pulsating vibration air supply port 33*e*1 is provided in a direction into a center line of the dispersion chamber 33 as shown with an imaginary line Lc in FIG. 6*b*, two swirls, both of which don't seem a dominant flow, are generated when the inner shape of the dispersion chamber 33 is approximately cylindrical. Therefore, it isn't preferable to provide the supply port 33*e*1 in such a position considering generation of the swirling positive pulsating vibration air in the dispersion chamber 33.

Next, the positional relation of the pulsating vibration air supply port 33*e*1 and discharge port 33*e*2 in the dispersion chamber 33 is detailed referring to FIG. 7.

Figure 7A:
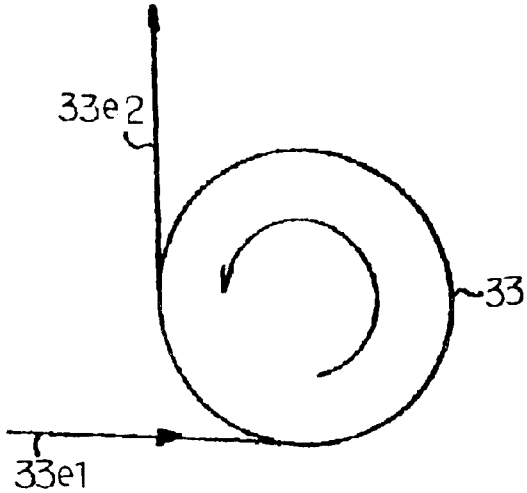
FIG. 7*a* is an explanatory view showing preferable positions for attaching the pulsating vibration air supply port and the discharge port to the dispersion chamber.
Figure 7B:
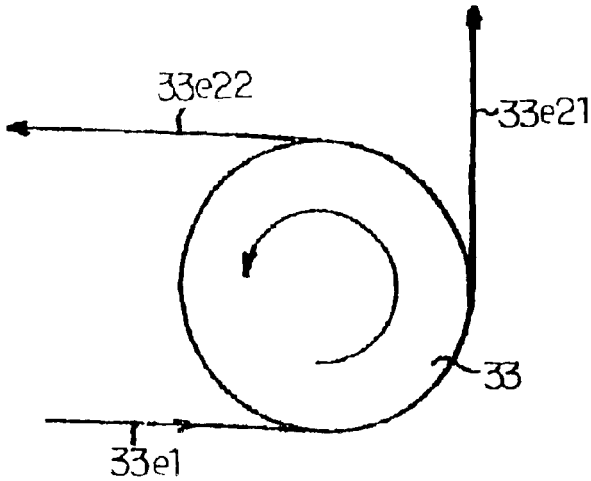
FIG. 7*b* is an explanatory view showing virtual attachable positions of the pulsating vibration air supply port and the discharge port to the dispersion chamber.

FIG. 7 is an explanatory view diagrammatically showing where the pulsating vibration air supply port 33*e*1 and discharge port 33*e*2 are provided for the dispersion chamber 33 seen two-dimensionally. FIG. 7*a* is an explanatory view showing preferable positions for attaching the pulsating vibration air supply port 33*e*1 and discharge port 33*e*2 on the dispersion chamber 33, and FIG. 7*b* is an explanatory view showing virtual attachable positions of pulsating vibration air supply port 31*e*1 and discharge port 33*e*2 on the dispersion chamber 33.

The curved arrows in FIG. 7*a* and FIG. 7*b* diagrammatically show directions of the swirling positive pulsating vibration air generated in the dispersion chamber 33.

When the discharge port 33*e*2 is provided for the dispersion chamber 33 as shown in FIG. 7*a*, the position of the port 33*e*2 becomes opposite to the direction of the swirling pulsating vibration air (movement of the air flow) generated in the chamber 33. In such a case, the discharge efficiency of the lubricant (powder) fluidized by being dispersed in air from the discharge port 33*e*2 can be set low.

Contrary if the discharge efficiency of the fluidized lubricant from the discharge port 33*e*2 is to be heightened, the port 33*e*2 is preferably provided in a forward direction of the swirling positive pulsating vibration air generated in the dispersion chamber 33 like the discharge port 33*e*21 or 33*e*22 illustrated in FIG. 7*b*.

A member 37 in FIG. 1 is a pressure sensor for confirming the pressure in the cylindrical body 31, namely in the powder material spraying device 1.

A member 38 is a level sensor constructed with a light emitting element 38*a* and a light receiving element 38*b* to detect the residual amount of the lubricant (powder) in the powdered material storage hopper 2 in this embodiment.

The members 37, 38 are provided if necessary and aren't indispensable members.

Next, an application of the powder material spraying device 1 is exemplified.

Figure 8:
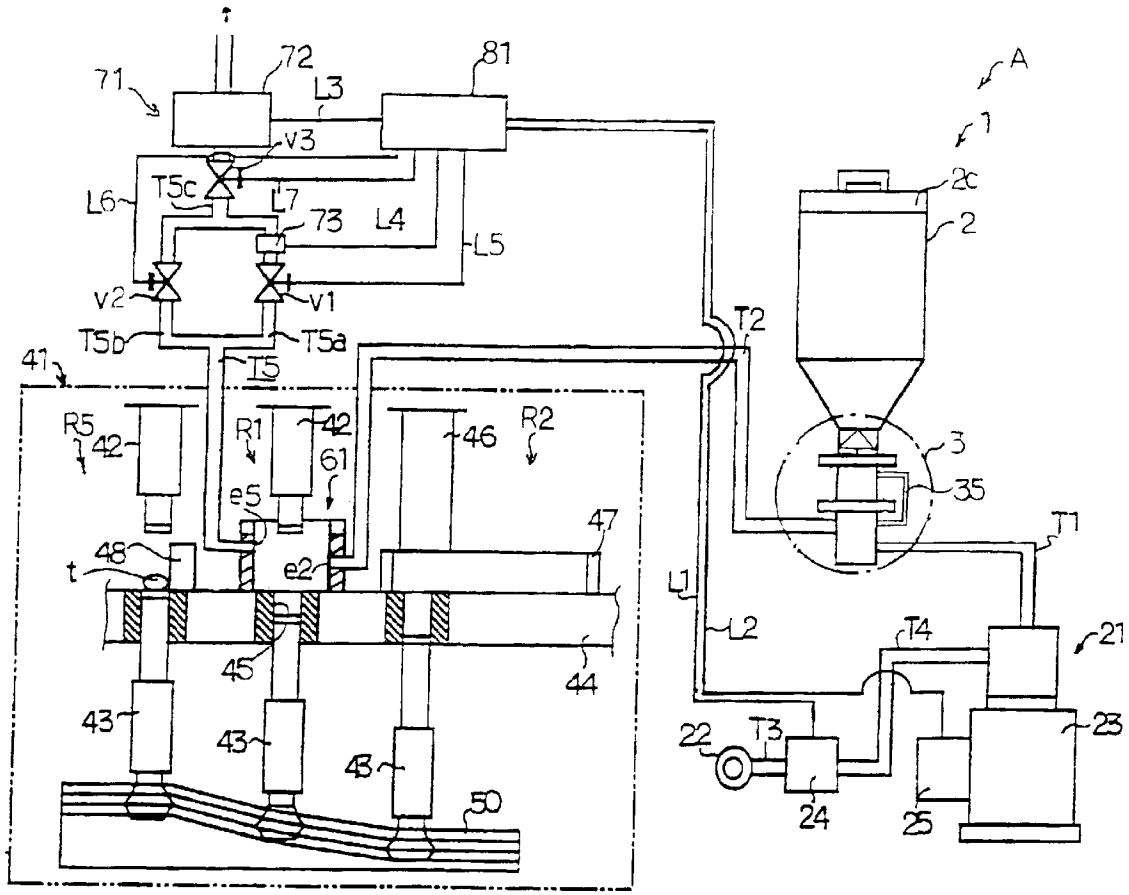
FIG. 8 shows an entire configuration of an external lubrication type tabletting machine having the powdered material spraying device of the present invention.

FIG. 8 shows an entire configuration of an external lubrication type tabletting machine having the powdered material spray device 1 of the present invention.

The external lubrication type tabletting machine A is provided with pulsating vibration air generation means 21, a lubricant spraying chamber 61 at a predetermined position in a rotary type tabletting machine 41, lubricant suction means 71 for removing the surplus lubricant sprayed in the lubricant spraying chamber 61, and a processing unit 81 for controlling and supervising the entire external lubrication type tabletting machine A.

The pulsating vibration air generation means 21 has a compressed air source 22 such as a blower and pulsating vibration air conversion means 23 for converting the compressed air generated by the source 22 into a positive pulsating vibration air. The member shown as a numeral 24 in FIG. 8 is flow rate control means comprised of an electromagnetic valve for adjusting the flow rate of the compressed air generated by the source 22 and may be provided if necessary.

The compressed air source 22 and the flow rate control means 24 are connected with a conduit T3, and the flow rate control means 24 and the pulsating vibration air conversion means 23 are connected with a conduit T4 in this embodiment. The compressed air generated from the source 22 is supplied to the flow rate control means 24 via the conduit T3 to be adjusted into a predetermined flow rate, then is supplied to the pulsating vibration air conversion means 23 via the conduit T4.

The member shown by a numeral 25 in FIG. 8 is rotary drive means such as a motor to drive and rotate a rotary cam (refer to a rotary cam 29 in FIG. 10) for converting a compressed air into a pulsating vibration air.

The pulsating vibration air generation means 21 and the powder material spraying device 1 are connected via a conduit T1 to supply the positive pulsating vibration air from the generation means 21 into the powder material spraying device 1 via the conduit T1.

In more detail, the pulsating vibration air conversion means 23 of the pulsating vibration generation means 21 is connected with one end T1*a* of the conduit T1 and the other end T1*b* is connected with the pulsating vibration air supply port 33*e*1 of the dispersion chamber 33 of the powder material spraying device 1.

The powder material spraying device 1 and the lubricant spraying chamber 61 are connected with the conduit T2. The lubricant (powder) which is discharged from the powder material spraying device 1 and mixed to be dispersed with the positive pulsating vibration air in the conduit T2 is supplied to the lubricant spraying chamber 61 via the conduit T2.

Next, a construction of the rotary type tabletting machine 41 is explained.

Figure 9:
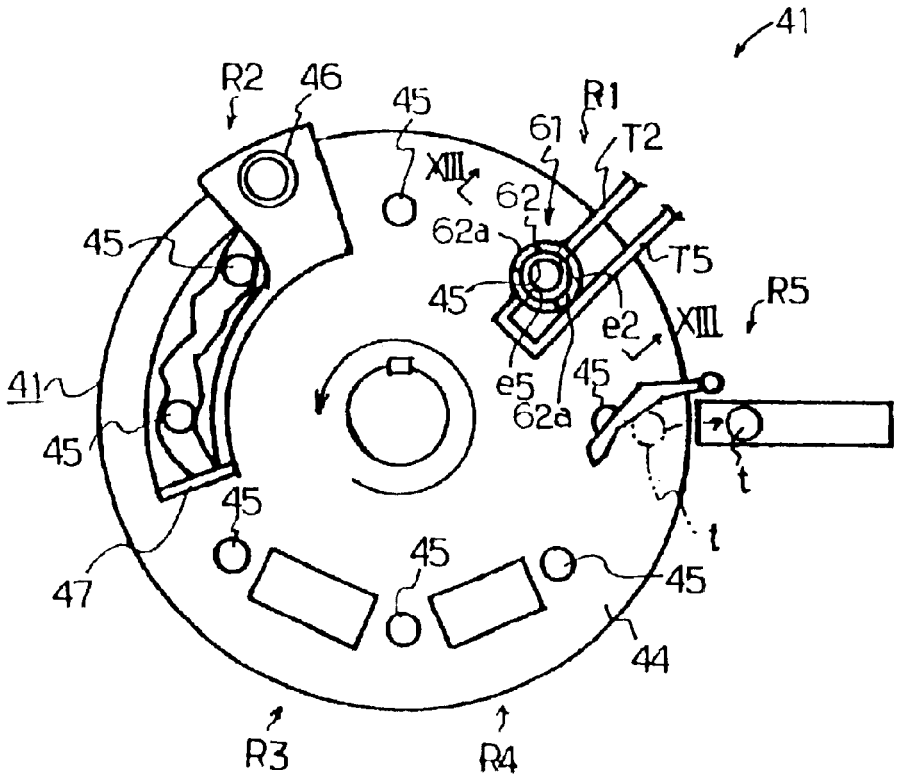
FIG. 9 is a plane view diagrammatically showing a rotary type tabletting machine of the external lubrication type tabletting machine of FIG. 8.

FIG. 9 is a plane view diagrammatically showing the rotary type tabletting machine 41.

A regular one is used as the rotary type tabletting machine 41. Namely, the tabletting machine 41 has a turntable 44 rotatably provided for a rotary axis, plural upper punches 42 . . . , and plural lower punches 43 . . . .

Plural dies 45 . . . are formed on the turntable 44 and the upper punch 42 and a corresponding lower punch 43 are provided for each die 45 in such a manner that plural upper punches 42 plural lower punches 43 . . . and plural dies 45 . . . are synchronously rotated.

The plural upper punches 42 . . . are designed to be movable up and down into an axial direction of the rotary axis at a predetermined position by means of a cam mechanism (not shown). The plural lower punches 42 . . . are also designed to be movable up and down into an axial direction of the rotary axis at a predetermined position by means of a cam mechanism 50.

A member shown in a numeral 46 in FIG. 8 and FIG. 9 is a feed shoe for filling a molding material in each die 45 . . . and a member 47 is a scraper for making the filled material in the die 45 at a predetermined amount, and a member 48 is a tablet discharge scraper for discharging a produced tablet t to a discharge chute 49.

A position shown as R1 in FIG. 9 is a lubricant spraying point, at which the lubricant spraying chamber 61 is provided in this external lubrication type tabletting machine A. More specifically, the lubricant spraying chamber 61 is fixedly provided on the turntable 44 in such a manner that the lubricant is sprayed on each surface of the dies 45 . . . , the upper punches 42 . . . , and the lower punches 43 . . . which are contained in the chamber 61 accompanying rotation of the dies 45 . . . , the upper punches 42 . . . , and the lower punches 43 . . . . A method for spraying the lubricant on the dies 45 . . . , the upper punches 42 . . . , and the lower punches 43 . . . in the lubricant spraying chamber 61 is detailed later.

A position R2 in FIG. 9 is a material filling point by means of the feed shoe 46 where a molding material m is filled in a cavity formed with the die 45 and the lower punch 43 inserted at a predetermined position in the die 45.

A position R3 in FIG. 9 is a pre-tabletting point where a fixed amount of molding material which is filled in the cavity formed by the die and the lower punch 43 and is scraped by the scraper 47 is preliminary tabletted by means of the upper punch 42 and the corresponding lower punch 45.

A position R4 in FIG. 9 is a main tabletting point where the pre-tabletted molding material is fully compressed by the upper punch 42 and the corresponding lower punch 45 so as to produce a tablet t.

A position R5 in FIG. 9 is a tablet discharging point where the tablet t discharged outside when the upper surface of the lower punch 43 is inserted into the upper end of the die 45 is discharged to the discharge chute 49 by means of the tablet discharging scraper 48.

Next, a configuration of the pulsating vibration air conversion means 23 comprising the pulsating vibration air generation means 21 is detailed hereinafter.

Figure 10:
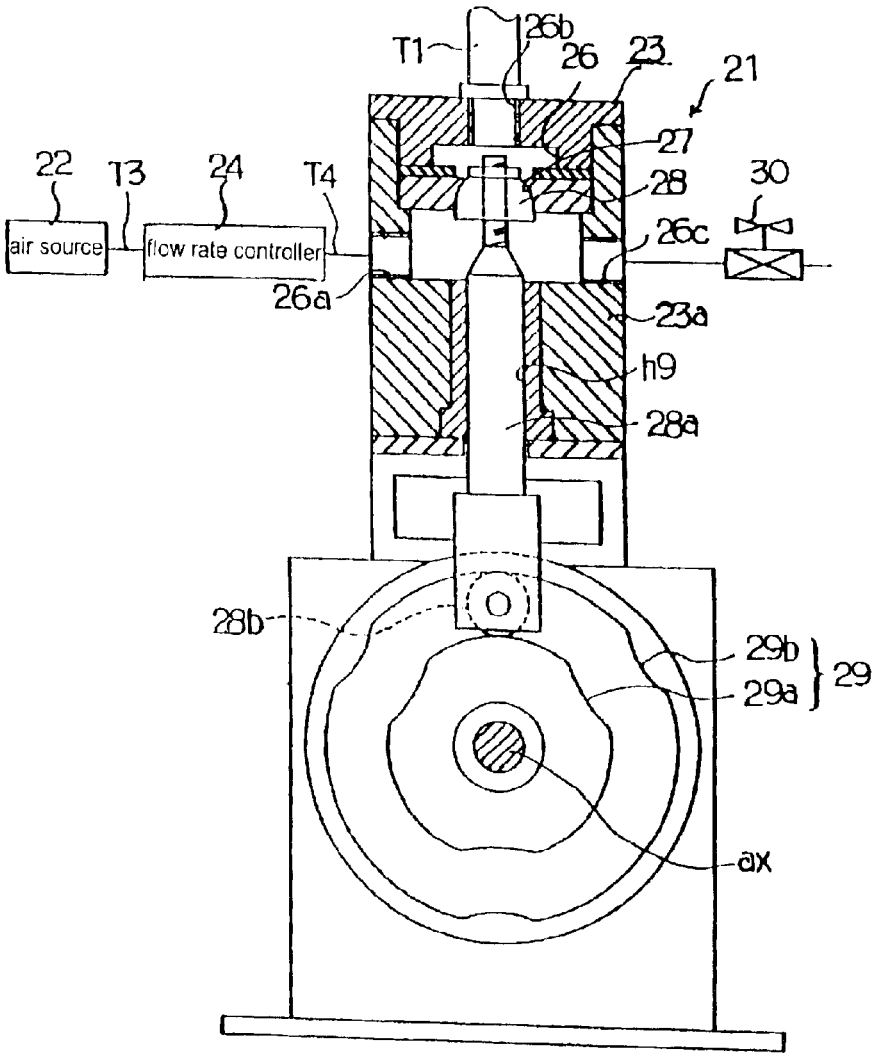
FIG. 10 is a sectional view diagrammatically showing a configuration of pulsating vibration air generation means used for the powdered material spraying device of the present invention around pulsating vibration air conversion means.

FIG. 10 is a sectional view diagrammatically showing a configuration of the pulsating vibration air generation means 21 around the pulsating vibration air conversion means 23.

The pulsating vibration air conversion means 23 has a hollow chamber 26 with an air supply port 26*a* and an air discharge port 26*b*, a valve seat 27 provided in the chamber 26, a valve plug 28 for opening and closing the valve seat 27, and a rotary cam 29 for opening and closing the valve plug 28 for the valve seat 27.

The conduit T4 is connected to the air supply port 26*a* and the conduit T1 is connected to the air discharge port 26*b*.

A numeral 26*c* in FIG. 10 is a pressure regulating port provided in the hollow chamber 26 if necessary and a pressure regulating valve 30 is provided so as to communicate with or shut off from atmosphere.

The valve plug 28 has a shaft 28*a* which is rotatably connected to a rotary roller 28*b*.

A shaft hole h9 for containing the shaft 28*a* of the valve plug 28 airtightly and movably up and down is provided for a body 23*a* of the pulsating vibration air conversion means 23.

The rotary cam 29 has an inside rotary cam 29*a* and an outside rotary cam 29*b*.

A predetermined concavo-convex pattern is formed on each one of the inside rotary cam 29*a* and the outside rotary cam 29*b* so as to have a space about the distance of the diameter of the rotary roller 28*b*.

The rotary cam 29 which has a concavo-convex pattern suitable for mixing and dispersing a lubricant (powder) depending on its physical property is used.

The rotary roller 28*b* is rotatably inserted between the inside rotary cam 29*a* and the outside rotary cam 29*b* of the rotary cam 29.

A member shown as ax in FIG. 10 is a rotary axis of the rotary drive means 25 such as a motor and the rotary cam 29 is detachably provided for the rotary axis ax.

Next, a method for supplying a positive pulsating vibration air to the conduit T1 by means of the pulsating vibration air generation means 21 is explained.

At first, the rotary cam 29 with a concavo-convex pattern suitable for mixing and dispersing a lubricant (powder) depending on its physical property is attached on the rotary axis ax of the rotary drive means 25.

Then the air source 22 is driven to supply a compressed air to the conduit T3.

When the flow rate control means 24 is provided, the compressed air supplied to the conduit T3 is fed to the conduit T4 after being adjusted to a predetermined flow amount by the flow rate controller means 24. The fixed amount of compressed air thus fed in the conduit T4 is supplied to the hollow chamber 26 from the air supply port 26*a*.

The air source 22 and the rotary drive means 25 are driven, so that the rotary cam 29 attached to the rotary axis ax of the rotary drive means 25 is rotated at a fixed rotational speed.

Accordingly, the rotary roller 28*b* is rotated between the inside rotary cam 29*a* and the outside rotary cam 29*b* of the rotary cam 29 which are rotated at a predetermined rotational speed in such a manner that the rotary roller 28*b* reproducibly moves up and down according to the pattern of the rotary cam 29. As a result, the valve plug 28 opens and closes the valve seat 27 according to the concavo-convex pattern formed on the rotary cam 29.

If a pressure-regulating port 26*c* and the pressure-regulating valve 30 are provided for the hollow chamber 26, the pressure of the positive pulsating vibration air supplied to the conduit T1 is regulated by appropriately controlling the valve 30.

Thus a positive pulsating vibration air is fed to the conduit T1.

The wavelength of the positive pulsating vibration air fed in the conduit T1 is properly regulated depending on the concavo-convex pattern of the rotary cam 29 and/or the rotational speed of the rotary cam 29. The wave shape of the positive pulsating vibration is also adjusted by the concavo-convex pattern of the rotary cam 29. The amplitude of the positive pulsating vibration air is controlled by adjusting the drive amount of the air source 22, by adjusting the flow rate control means 24 if it is provided, by properly adjusting the pressure-regulating valve 30 provided for the pressure-regulating port 26*c* if they are provided, or by combining and adjusting them.

FIG. 11 is an explanatory view exemplifying the positive pulsating vibration air thus supplied in the conduit T1.

Figure 11A:
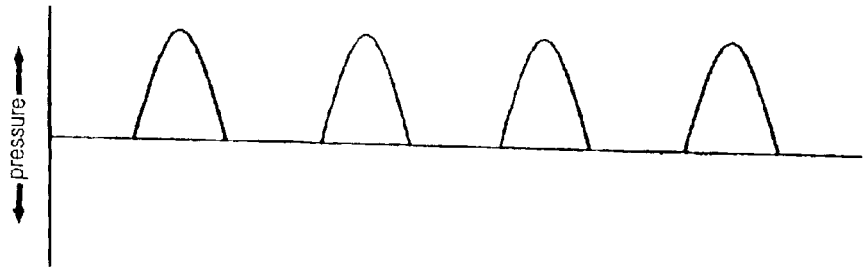
FIG. 11 is an explanatory view exemplifying a positive pulsating vibration air supplied in an introduction pipe.
Figure 11B:
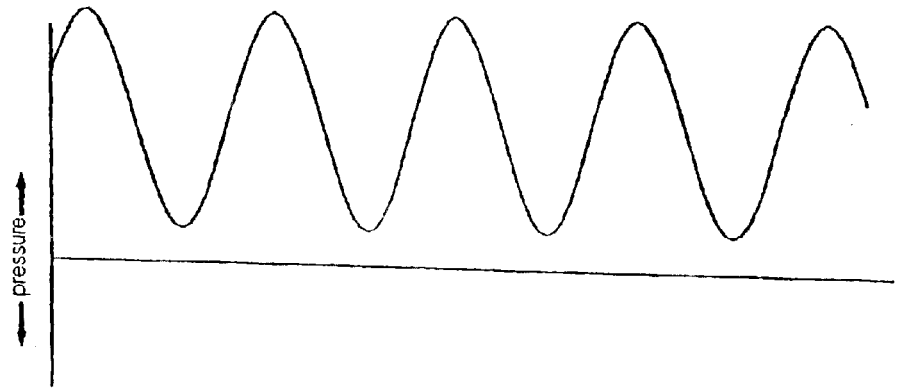

The positive pulsating vibration air supplied in the conduit T1 may be a pulsating vibration air of which the peak amplitude is positive and the valley is atmospheric pressure as shown in FIG. 11*a* or may be a positive pulsating vibration air of which the peak and valley are positive as shown in FIG. 11*b*.

Next, operations of the powder material spraying device 1 are explained.

When a lubricant (powder) is quantitatively supplied to the lubricant spraying chamber 61 by mean of the powder material spraying device 1, the lubricant (powder) is stored in the powdered material storage hopper 2 of which the material feed port 2*b* is airtightly provided with a cover 2*c*.

Then the rotary cam 29 with a concavo-convex suitable for mixing and dispersing the lubricant (powder) depending on its physical property is attached to the rotary axis ax of the rotary drive means 25 of the pulsating vibration air conversion means 23.

Next, the air source 22 and the rotary drive means 25 of the pulsating vibration air conversion means 23 are driven to be rotated at a fixed rotational speed, thereby supplying a positive pulsating vibration air with a desired flow rate, pressure, wavelength and wave shape to the conduit T1.

The positive pulsating vibration air thus supplied in the conduit T1 is fed in the dispersion chamber 33 from the pulsating vibration air supply port 33*e*1 and it swirls upwardly in the chamber 33 like a tornado, then is discharged from the discharge port 33*e*2.

The swirling positive pulsating vibration air generated in the dispersion chamber 33 doesn't lose its nature as a pulsating vibration air so that the elastic membrane 32 vibrates according to the frequency, amplitude, and wave shape of the positive pulsating vibration air.

When the level sensor 36 is actuated to emit light from the light emitting element 36*a* and the light is received by the light receiving element 36*b*, the material feed valve 34 provided at the discharge port 2*a* of the material storage hopper 2 is moved downward to open the discharge port 2*a*. Then the lubricant (powder) stored in the hopper 2 is discharged to the cylindrical body 31 from the discharge port 2*a* to be accumulated on the elastic membrane 32.

When the height H of the accumulated lubricant (powder) on the elastic membrane 32 exceeds the height Hth where the level sensor 36 is provided, the light emitted from the light emitting element 36*a* is intercepted by the lubricant (powder) accumulated on the membrane 32, therefore the light receiving element 36*b* doesn't receive the light emitted from the light emitting element 36*a*. Therefore, the material feed valve 34 provided at the material discharge port 2*a* of the powdered material storage hopper 2 moves upward to close the port 2*a*. The lubricant (powder) is accordingly accumulated on the elastic membrane 32 upto the position Hth where the level sensor 36 is provided.

Next the operations of the powder material spraying device 1 are explained.

FIG. 12 is an explanatory view diagrammatically showing the operations of the elastic membrane 32 of the powder material spraying device 1.

Figure 12A:
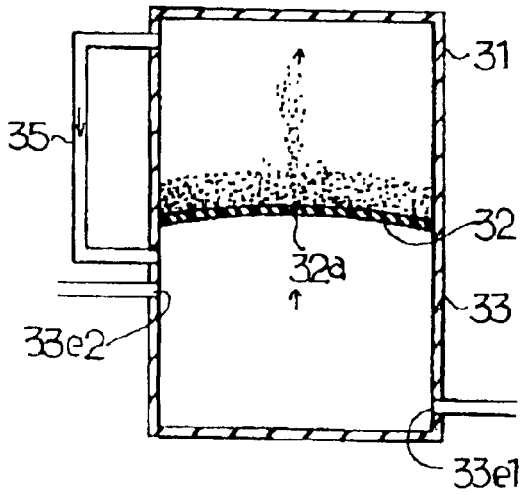
FIG. 12 is an explanatory view diagrammatically showing operations of an elastic membrane of the powdered material spraying device of FIG. 1.

When the pressure Pr33 in the dispersion chamber 33 becomes, for example, higher than the pressure Pr31 in the cylindrical body 31 at a peak of the positive pulsating vibration air in the dispersion chamber 33 (pressure Pr33>pressure Pr31), the elastic membrane 32 is elastically deformed with its center curved upwardly as shown in FIG. 12*a*.

A penetrating aperture 32*a* becomes V-shaped with its upper end opened when seen sectionally in this time and a part of lubricant (powder) stored on the elastic membrane 32 in the cylindrical body 31 falls in the V-shaped aperture 32*a*.

Figure 20A:
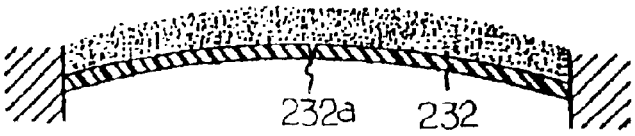
FIG. 20 is an explanatory view diagrammatically showing operations of an elastic membrane of a conventional minute powder spraying means.
Figure 20B:
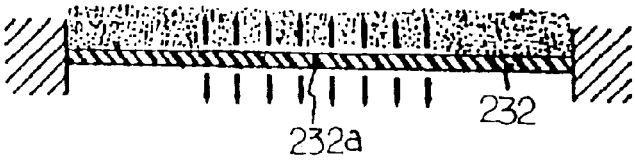
Figure 20C:
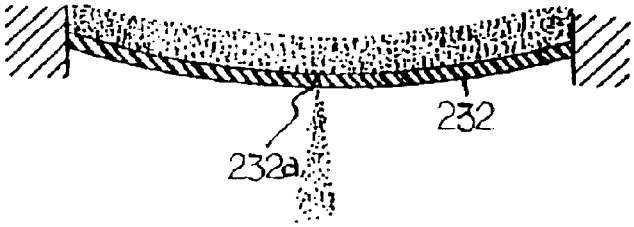

Such an operation is the same as the elastic membrane 232 as shown in FIG. 20. However, in this embodiment, a bypass pipe 35 is newly provided between the dispersion chamber 33 and the cylindrical body 31 so that the elastic membrane 32 vibrates up and down with almost equal amplitudes in up and down directions with its original tension being its neutral position, thereby achieving an accurate vibration.

Accordingly, an air communication passage between the cylindrical body 31 and the dispersion chamber 33 is formed with two systems in this powder material spraying device 1: the penetrating aperture 32*a* of the elastic membrane 32 and the bypass pipe 35. Therefore, the air can pass through the cylindrical body 31 and the dispersion chamber 33 via an available system.

When the air flows from the dispersion chamber 33 to the cylindrical body 31 via the penetrating aperture 32*a* of the elastic membrane 32 as shown in FIG. 12*a*, the air flow from the cylindrical body 31 to the dispersion chamber 33 is generated in the bypass pipe 35. Accordingly the air can flow therebetween via the aperture 32*a* comparing with the minute amount of powder spraying means 201 without the bypass pipe 35.

Then the pressure Pr33 in the dispersion chamber 33 becomes equal to the pressure Pr31 in the cylindrical body 31 as the positive pulsating vibration air gradually comes to its valley of the amplitude (pressure Pr33=pressure Pr31), the elastic membrane 32 returns to its original position from an upwardly curved position. At the same time the penetrating aperture 32*a* returns to its original position from the V shape and the powdered material dropped in the opened aperture 32*a* is kept therein (see FIG. 12*b*).

As the air communication passage between the cylindrical body 31 and the dispersion chamber 33 of the spraying device 1 is comprised of two lines: the penetrating aperture 32*a* of the elastic membrane 32 and the bypass pipe 35, the air can flow therebetween via an available line.

Figure 12B:
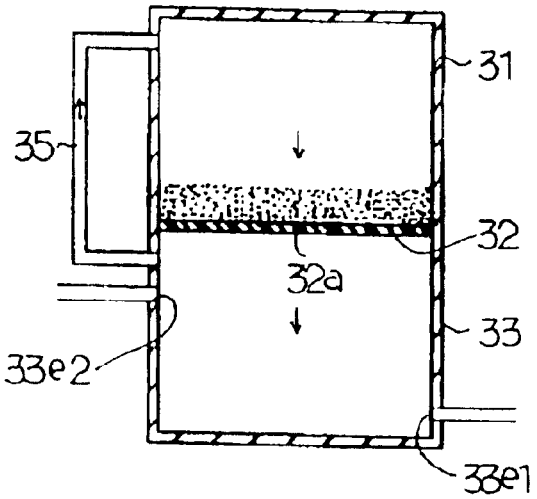
Figure 12C:
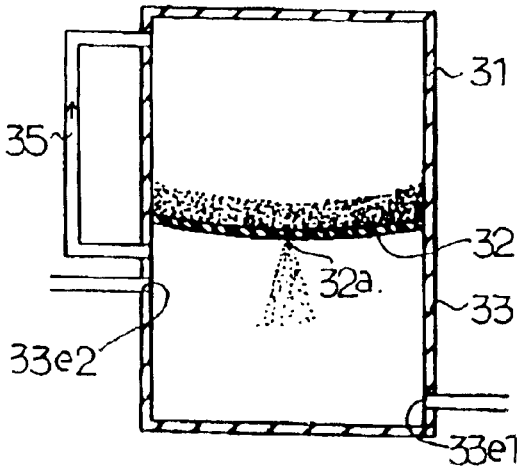
Figure 19:
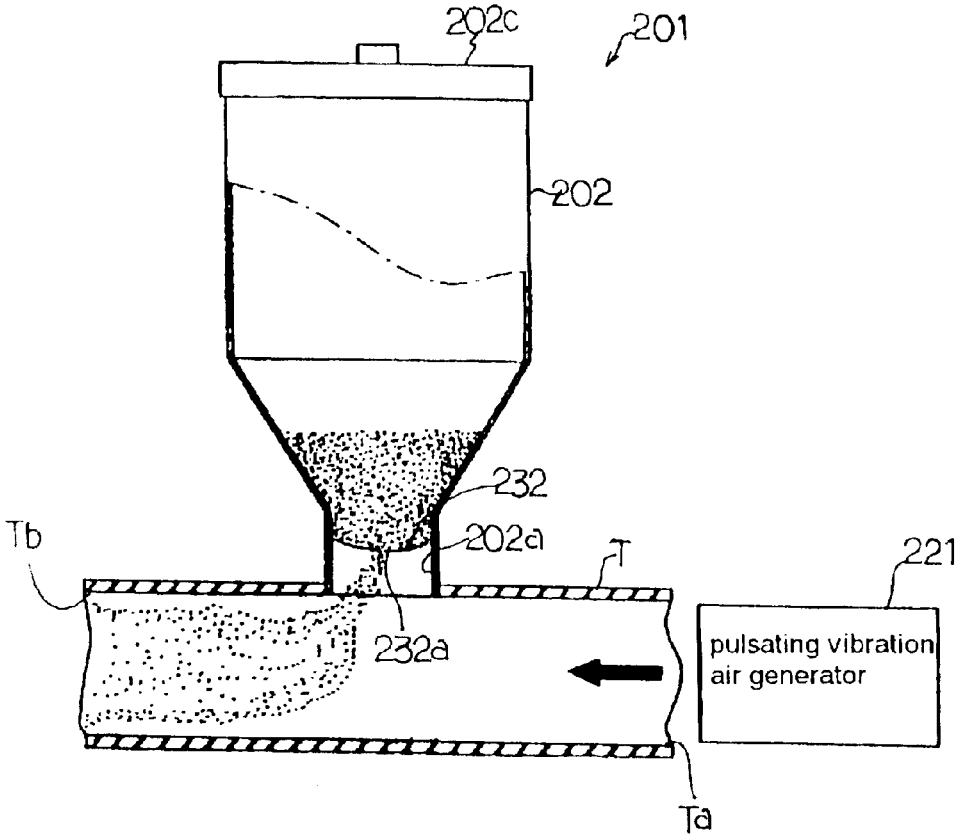
FIG. 19 shows a diagrammatic configuration of conventional minute powder spraying means.

Namely when the penetrating aperture 32*a* is closed as shown in FIG. 12*b*, the air can flow from the cylindrical body 31 to the dispersion chamber 33 via the bypass pipe 35, therefore the pressure in the dispersion chamber 33 and the pressure in the cylindrical body 31 are rapidly balanced comparing with the minute amount of powder spraying means 201 without having the bypass pipe 35 as shown in FIG. 19 and FIG. 20.

Next the pressure Pr33 in the dispersion chamber 33 is reduced at the amplitude valley of the positive pulsating vibration air, the elastic membrane 32 is elastically deformed with its center curved downwardly. The penetrating aperture 32*a* becomes reverse V-shaped with its lower end opened when seen sectionally. Then the powdered material kept in the aperture 32*a* falls in the dispersion chamber 33 (see FIG. 12*c*).

When the powdered material kept in the aperture 32*a* is discharged in the dispersion chamber 33, the air flows between the cylindrical body 31 and the dispersion chamber 33 through an available line because there are two air communication passages therebetween, namely the penetrating aperture 32*a* and the bypass pipe 35.

In other words, the elastic membrane 32 is curved downwardly and the volume of the cylindrical body 31 becomes larger, the air flows from the dispersion chamber 33 to the cylindrical body 31 via the bypass pipe 35. Therefore, the air flow from the dispersion chamber to the cylindrical body 31 via the penetrating aperture 32*a* isn't caused. Accordingly, the powdered material can be smoothly discharged through the aperture 32*a* comparing with the spraying means 201 without the bypass pipe 35 as shown in FIG. 19 and FIG. 20.

Thus, the time required for balancing the pressure Pr31 in the cylindrical body 31 and the pressure Pr33 in the dispersion chamber 33 is reduced when the positive pulsating vibration air is supplied in the dispersion chamber 33 of the spraying device 1 so that the responsibility of the vertical vibration of the elastic membrane 32 to the vibration of positive pulsating vibration air is superior. As a result, the powdered material can be smoothly discharged via the penetrating aperture 32*a*.

Furthermore, according to the powder material spraying device 1, the lubricant (powder) dropped in the dispersion chamber 33 is mixed and dispersed with the positive pulsating vibration air to be fluidized and is discharged from the discharge port 33*e*2 to the conduit T2 together with the positive pulsating vibration air.

The discharged lubricant (powder) mixed and dispersed with the positive pulsating vibration air in the conduit T2 is pneumatically transported by the positive pulsating vibration air to be fed in the lubricant spraying chamber 61 from the other end of the conduit T2 (see the other end e2 of the conduit T2 as shown in FIG. 8 and FIG. 9).

Such discharge of the lubricant (powder) to the dispersion chamber 33 via the penetrating aperture 32*a* of the elastic membrane 32 is repeated while the spraying device 1 is operated.

The light emitting element 36*a* of the level sensor 36 is lighted on while the quantitative spraying device 3 of the spraying device 1 is operated. When the light receiving element 36*b* receives the light emitted from the light emitting element 36*a*, the material feed valve 34 is moved downward to open the discharge port 2*a* of the material storage hopper 2. When the light receiving element 36*b* doesn't receive the light emitted from the light emitting element 36*a*, the material feed valve 34 is moved upward to close the discharge port 2*a* of the hopper 2. Accordingly, a fixed amount of lubricant (powder), namely at the height Hth where the level sensor 36 is provided above the elastic membrane 32, always exists on the elastic membrane 32.

According to the powder material spraying device 1, the up and down vibrations wherein the center of the elastic membrane 32 is operated as the antinode of the vibration and the periphery is operated as its node depend on by the frequency, amplitude and wave shape of the positive pulsating vibration air supplied in the dispersion chamber 33. Therefore, as long as the positive pulsating vibration air supplied in the dispersion chamber 33 is constant, a fixed amount of lubricant (powder) is always accurately discharged to the dispersion chamber 33 via the penetrating aperture 32*a* of the elastic membrane 32. Accordingly such a powder material spraying device 1 is superior as a device for supplying a fixed amount of powder (lubricant (powder) in this embodiment) to a desired place (lubricant spraying chamber 61 in this embodiment).

The powder material spraying device 1 also has an advantage that if the frequency, amplitude and wave shape of the positive pulsating vibration air supplied in the dispersion chamber 33 are controlled, the amount of powder (lubricant (powder) in this embodiment) supplied to a desired place (lubricant spraying chamber 61 in this embodiment) can be easily changed.

Furthermore according to the spraying device 1, the positive pulsating vibration air becomes a swirl directing upward. Even if the aggregated particles with large diameter are contained in the powder (lubricant (powder) in this embodiment) discharged to the dispersion chamber 33, most of all can be dispersed into small particles by being caught in the positive pulsating vibration air swirling in the dispersion chamber 33.

In addition, the positive pulsating vibration air in the dispersion chamber 33 becomes an upward swirling flow so that the dispersion chamber 33 has a size classification function like a cyclone. Therefore, the powdered material (lubricant (powder) in this embodiment) with a predetermined particle size can be discharged to the conduit T2 from the discharge port 33*e*2. On the other hand, the aggregated particles with a large diameter keep swirling in the lower part of the dispersion chamber 33 and are pulverized into a predetermined particle size by being caught in the positive pulsating vibration air swirling in the chamber 33, and then are discharged to the conduit T2 from the discharge port 33*e*2.

Therefore, such a powder material spraying device 1 has an advantage that a fixed amount of powdered material (lubricant (powder) in this embodiment) with a uniform particle size can be fed to an objected place (lubricant spraying chamber 61 in this embodiment).

Then the powdered material (lubricant (powder) in this embodiment) supplied in the conduit T2 is pneumatically transported to the other end e2 of the conduit T2 by means of the positive pulsating vibration air.

Thereby, according to the powder material spraying device 1, a deposit phenomenon and a pinhole phenomenon aren't caused in the conduit T2, which have been seen in transportation means wherein the powdered material supplied in the conduit T2 is pneumatically transported to the other end e2 of the conduit T2 by a steady pressure air with constant flow.

Therefore, according to the powder material spraying device 1, the powdered material (lubricant (powder) in this embodiment) can be discharged from the other end e2 of the conduit T2 while keeping the concentration of the original powdered material discharged in the conduit T2 from the discharge port 33*e*2 of the dispersion chamber 33, thereby enabling an accurate control of the quantitativeness of the powdered material (lubricant (powder) in this embodiment) sprayed from the other end e2 of the conduit T2.

Furthermore, according to the powder material spraying device 1, a fixed amount of powdered material (lubricant (powder) in this embodiment) is placed on the elastic membrane 32 at the height Hth where the level sensor 36 is provided above the membrane 32 while operating the means 1. The amount of powdered material (lubricant (powder) in this embodiment) discharged from the penetrating aperture 32*a* of the elastic membrane 32 doesn't vary depending on the change in the amount of powdered material placed on the elastic membrane 32. Accordingly, the powder material spraying device 1 is superior as a device for supplying a fixed amount of powdered material (lubricant (powder) in this embodiment) to a desired place (lubricant spraying chamber 61 in this embodiment).

Still further according to the powder material spraying device 1, even if the large size powdered material (lubricant (powder) in this embodiment) is discharged to the dispersion chamber 33, such a material is pulverized into a predetermined particle size by being caught in the positive pulsating vibration air swirling in the chamber 33 and discharged to the conduit T2 from the discharge port 33*e*2, so that the large sized powdered material isn't deposited in the dispersion chamber 33.

Therefore, if the quantitative spraying device 3 of the powder material spraying device 1 is operated for a long time, the powdered material (lubricant (powder) in this embodiment) doesn't deposit in the dispersion chamber 33 so that the number of cleaning in the dispersion chamber 33 can be reduced.

When such a powder material spraying device 1 is attached to the external lubrication type tabletting machine A, the cleaning in the dispersion chamber 33 isn't almost required while executing a continuous tabletting. Therefore, there is an effect that an externally lubricated tablet (tablet without including lubricant) can be effectively produced using such a tabletting machine A.

Additionally the elastic membrane 32 of the powder material spraying device 1 is stretched by means of the elastic membrane installation means 5 as shown in FIG. 3, FIG. 4 and FIG. 5. The quantitativenes of powdered material spraying device (quantitative feed means) isn't damaged because of a loosed elastic membrane 32.

Next a configuration of the lubricant spraying means 61 is explained.

Figure 13:
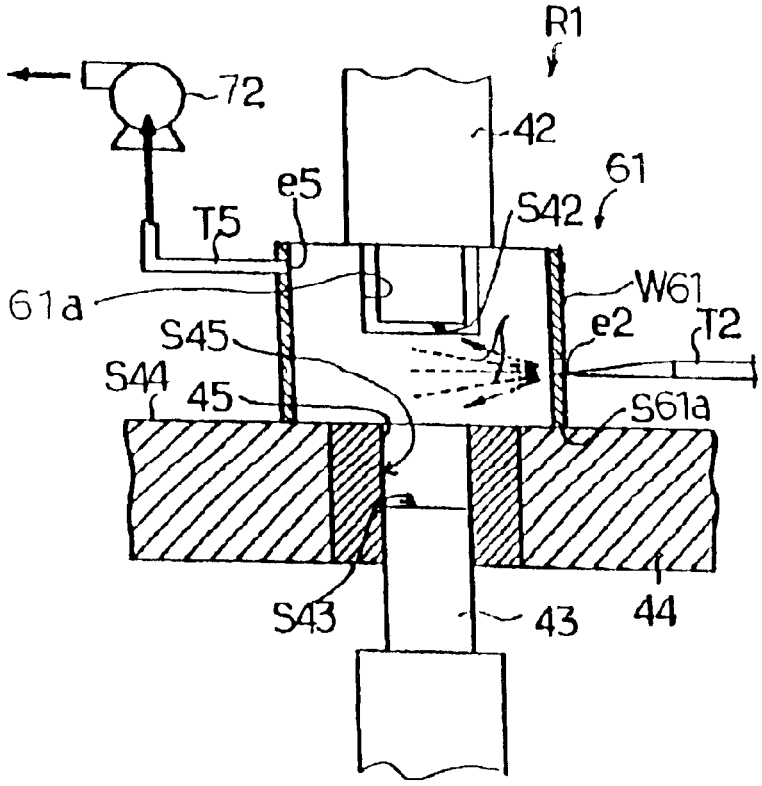
FIG. 13 is a sectional view diagrammatically showing a configuration of a lubricant spraying chamber taken along line XIII—XIII of FIG. 9.

FIG. 13 is a sectional view diagrammatically showing a configuration of the lubricant spraying chamber 61 taken along line XIII—XIII of FIG. 9.

The diameter of the lubricant spraying chamber 61 is a little larger than the diameter of the dies 43 . . . formed on the turntable 44 and a lower surface S61*a* and an upper surface S61*b* are opened respectively. An upper punch accommodation concave 61*a* for containing the upper punches 42 . . . in the chamber 61 is formed, if required, at an upper part of a rising wall W61 of the lubricant spraying chamber 61 in a rotary orbit direction of the upper punches 42 . . . .

The end e2 of a conduit T2 is connected to the rising wall W61 of the spraying chamber 61 and the powdered material (lubricant (powder) in this embodiment) mixed with and dispersed by the positive pulsating vibration air supplied via the conduit T2 is designed to be sprayed from the end e2 together with the positive pulsating vibration air.

An end e5 of a suction duct T5 connected to suction means 72 of lubricant suction means 71 is connected to the rising wall W61 of the lubricant spraying chamber 61. When the suction means 72 is driven, the surplus powdered material among the material (lubricant (powder) in this embodiment) sprayed in the chamber 61 is sucked.

The lubricant spraying chamber 61 is fixedly provided such that the rotary orbit of the dies 45 . . . formed on the turntable 44 is positioned on the lubricant spray point R1. The turntable 44 is rotated in such a manner that a surface S44 of the turntable 44 rubs on the lower surface S61*a* of the chamber 61.

A lubricant (powder) is applied on the upper punches 42 . . . , the lower punches 43 . . . and the dies 45 . . . in the lubricant spraying chamber 61 as follows.

The lubricant (powder) mixed with and dispersed by the positive pulsating vibration air is sprayed in the lubricant spraying chamber 61 from the end e2 of the conduit T2. Then the suction means 72 is driven at an appropriate driving amount so as to suck the surplus lubricant (powder) sprayed in the chamber 61 from the end e5 of the suction duct T5. The lubricant spraying chamber 61 is thereby kept in a condition that the lubricant (powder) with a fixed concentration is mixed and dispersed in the positive pulsating vibration air.

The turntable 44, the upper punches 42 . . . and the lower punches 43 . . . are synchronously rotated and a lubricant is sequentially applied on a surface (upper surface) S43 of the lower punch 43 inserted to a fixed position in the die 45, a part of the inner circumference S45 in the die 45 above the surface (upper surface) S43 of the lower punch 43, the die 45 being fed under the lubricant spraying chamber 61, and a surface (lower surface) S42 of the upper punch 42 moved in the chamber 61.

In the lubricant spraying chamber 61, a lubricant (powder) is applied on the surface (upper surface) S43 of the lower punch 43, the part in the circumferential wall S45 of the die 45 above the surface (upper surface) S43 of the lower punch 43, and the surface (lower surface) S42 of the upper punch 42 under influence of the positive pulsating vibration air. Therefore, even if the surplus lubricant is adhered thereon, it is blown off at the peak of the positive pulsating vibration air. Thus blown lubricant (powder) is sucked from the end e5 of the suction duct T5 so that the minimum amount of lubricant (powder) can be uniformly applied on those surfaces.

Next, a construction of the lubricant suction means 71 is detailed.

Figure 14:
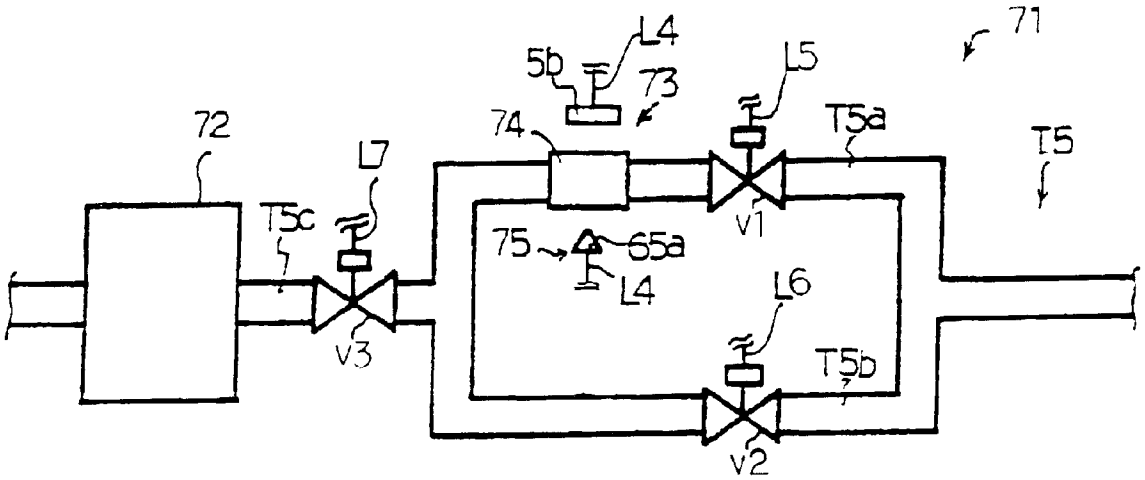
FIG. 14 is an enlarged view of a diagrammatic configuration around the lubricant suction means of FIG. 8.

FIG. 14 is an enlarged view of a diagrammatic configuration around the lubricant suction means 71 of FIG. 8.

The lubricant suction means 71 has the suction means 72 such as a blower and the suction duct T5 connected with the suction means 72.

One end of the suction duct T5 (see the end e2 of the suction duct T5 in FIG. 8) is connected to the lubricant spraying chamber 61. The duct T5 is once divided into two branch pipes T5*a*, T5*b* which are then integrated into a conduit T5*c* to be connected to the suction means 72.

Conduit switch means v1 such as an electromagnetic valve and light permeable type powder concentration measuring means 73 are sequentially provided into a direction of the suction means 72 from the end e2 of the suction duct T5.

The light permeable type powder concentration measuring means 73 has a measurement cell 74 and light permeable type measuring means 75.

The measurement cell 74 is made of quartz and connected in midstream of the branch pipe T5*a*.

The light permeable type measuring means 75 is provided with laser beam emitting means 75*a* for emitting laser beams and scattering beam receiving means 75*b* for receiving the light scattered by an object and is designed to measure the flow rate, particle diameter, particle size distribution and concentration of the object according to the Mie theory. In this embodiment, the laser beam emitting means 75*a* and the scattering beam receiving means 75*b* are opposed so as to interpose the measurement cell 74 in such a manner that the flow rate, particle diameter, particle size distribution and concentration of the powdered material (lubricant (powder) in this embodiment) running in the branch pipe T5*a* can be measured in the measurement cell 74.

Conduit switch means v2 such as an electromagnetic valve is provided for the branch pipe T5*b*.

Further, conduit switch means v3 such as an electromagnetic valve is provided for the branch pipe T5*c*.

For controlling the concentration of the lubricant (powder) in the lubricant spraying chamber 61 by means of the lubricant suction means 71, the conduit switch means v1 and v3 are opened while the conduit switch means v2 is closed, and then the suction means 72 is driven.

When the pulsating vibration air generation means 21 and the powder material spraying device 1 are driven respectively, the lubricant mixed with and dispersed by the positive pulsating vibration air is supplied in the lubricant spraying chamber 61 together with the positive pulsating vibration air.

Then a part of the lubricant (powder) fed in the lubricant spraying chamber 61 is used for spraying on each surface (lower surface) S42 of the upper punches 42 . . . , each surface S43 (upper surface) of the lower punch 43 . . . , and each inner circumference S45 of the dies 45 . . . . The surplus lubricant is sucked to the suction means 72 from the end e5 of the suction duct T5 via the branch pipe T5*a* and the conduit T5*c*.

This time the light permeable type measuring means 75 consisting the light permeable type powder concentration measuring means 73 is driven to measure the flow rate, particle diameter, particle size distribution, and concentration of the lubricant (powder) running in the measurement cell 74, namely in the branch pipe T5*a*.

The concentration of the lubricant (powder) in the lubricant spraying chamber 61 is controlled by appropriately adjusting the control amount of the flow rate control means 24 and the drive amount of the pulsating vibration air generation means 21 depending on the measured value of the light permeable type measuring means 75.

Under such operations, a problem is caused such that the lubricant (powder) is adhered in the inner circumference of the measurement cell 74 and the permeable type measuring means 75 can't accurately measure the flow rate and so on of the lubricant running in the branch pipe T5*a* because of thus adhered lubricant. In such a case a compensation is required for removing the affection (noise) caused by the lubricant (powder) adhered in the measurement cell 74 from the measured value of the measuring means 75. However, according to the external lubrication type tabletting machine A, the conduit switch means v1 is closed and the conduit switch means v2 is opened while keeping the suction means 72 driven for measuring the affection (noise) by the lubricant. The lubricant (powder) sucked in the suction duct T5 from the end e5 of the suction duct T5 is further sucked in the suction means 72 so that the lubricant (powder) doesn't run in the branch pipe T5*a*.

When the permeable type measuring means 75 is driven at this time, the affection (noise) by the lubricant (powder) adhered in the measurement cell 74 can be measured.

The measured value of the affection (noise) by the lubricant (powder) adhered in the cell 74 is temporarily stored in memory means of the processing unit 81.

Thereafter, the conduit switch means v1 is opened and the conduit switch means v2 is closed while keeping the suction means 72 driven so as to run the lubricant (powder) through the branch pipe T5*a*. Then the permeable type measuring means 75 is driven to measure the flow rate and so on of the lubricant (powder) running in the measurement cell 7. The compensation value obtained by removing the affection (noise) of the lubricant (powder) adhered in the cell 74 from the measured value of the measurement means 75 based on the compensation program and the measured value of the affection (noise) of the lubricant (powder) adhered in the cell 74 stored in the memory means of the processing unit 81 in advance. Then the concentration of the lubricant (powder) in the lubricant spraying chamber 61 is controlled by adjusting the regulating amount of flow rate control means 24 and the driving amount of pulsating vibration air generation means 21.

According to the external lubrication type tabletting machine A shown in FIG. 8, the processing unit 81 and the flow rate control means 24 are connected by a signal line L1 in such a manner that the flow rate control means 24 can be controlled by command signals from the processing unit 81. Further, the processing unit 81 and the rotary drive means 25 are connected by a signal line L2 so that the rotational speed of the rotary axis of the rotary drive means 25 (see the rotary axis ax in FIG. 7) can be controlled by command signals from the processing unit 81.

In the external lubrication type tabletting machine A, the processing unit 81 and the suction means 72 are connected by a signal line L3 in such a manner that the drive amount of the suction means 72 is controlled by command signals from the processing unit 81. The processing unit 81 is also connected to the light permeable type powder concentration measuring means 73 (specifically light permeable type measuring means 75) via a signal line L4. According to command signals from the processing unit 81, the light permeable type measuring means 75 is driven, the measured value of the measuring means 75 is stored in the storage means in the processing unit 81, the drive amount of the suction means 72 is controlled based on the measured value of the measuring means 75 following a processing program stored in the memory means in the processing unit 81 in advance, and the driving amount of the pulsating vibration air generation means 21 is controlled, so that the concentration of the lubricant (powder) in the lubricant spraying chamber 61 can be controlled. The processing unit 81 is connected to the conduit switch means v1 by a signal line L5 so that the conduit switch means v1 can be opened and closed by command signals from the processing unit 81. The processing unit 81 and the conduit switch means v2 are connected by a signal line L6 so that the conduit switch means v2 can be opened and closed by command signals from the processing unit 81. Further, the processing unit 81 and the conduit switch means v3 are connected by a signal line L7, therefore the conduit switch valve v3 can be opened and closed by command signals from the processing unit 81.

In the external lubrication type tabletting machine A, the processing unit 81 is connected to the tabletting machine 41 via a signal line (not shown) so as to enable the tabletting machine 41 to be driven or stopped by command signals from the unit 81. Between the processing unit 81 and the air source 22 is connected by a signal line (not shown) so as to drive and stop the air source 22 and control the drive amount by command signals from the unit 81.

The processing unit 81 is further connected to the level sensor 36 by a signal line (not shown) so that the level sensor 36 is driven and stopped by command signals from the unit 81. When the level sensor 36 is driven, the signal detected by the light receiving element 36*b* comprising the level sensor 36 is transmitted to the processing unit 81.

The processing unit 81 is also connected to the material feed valve 34 by a signal line (not shown) in such a manner that the feed valve 34 moves up and down to open and close the discharge valve 2*a* of the powdered material storage hopper 2 according to command signals from the unit 81. In this embodiment, when the processing unit 81 receives signals from the light receiving element 36*b* indicating the light from the light emitting element 36*a* has been received while operating the level sensor 36, the processing unit 81 is designed to send signals to the material feed valve 34 to go downward. Upon receiving such signals, the material feed valve 34 goes down to open the discharge port 2*a* of the powdered material storage hopper 2.

When the processing unit 81 receives signals from the light emitting element 36*b* indicating that the light emitted from the element 36*a* isn't received while the level sensor 36 is operated, the processing unit 81 sends signals to the material feed valve 34 to go upward. Upon receiving such signals, the material feed valve 34 moves upward to close the discharge valve 2*a* of the powdered material storage hopper 2.

Next, a method for producing externally lubricated tablet (tablet without including lubricant) by means of the external lubrication type tabletting machine A shown in FIG. 8 is explained.

A molding material is charged in a feed shoe 46 of the external lubrication type tabletting machine A in order to produce a tablet t. In case of producing an external lubrication tablet, active substances (active ingredient or active material) and other additives excluding a lubricant (excipients; a disintegrant, a stabilizer, and an adjuvant added if required) are charged as a molding material.

A lubricant (powder) is contained in the powdered material storage hopper 2 comprising the powder material spraying device 1 and the cover 2*c* is airtightly attached on the material feed port 2*b* of the hopper 2.

Then a rotary cam (rotary cam 29 in FIG. 10) having a concavo-convex pattern which can generate a positive pulsating vibration air for easily mixing and dispersing the lubricant (powder) is attached to a rotary axis (rotary axis ax in FIG. 10) of the rotary drive means 25 of the pulsating vibration conversion means 23.

The processing unit 81 sends signals to the conduit switch means v1 to open the conduit T5*a* and sends signals to the conduit switch means v3 to open the branch pipe T5*c*. The unit 81 also sends signals to the conduit switch means v2 to close the branch pipe T5*b*. In case of measuring the affection (noise) of the lubricant (powder) adhered on the measurement cell 74, the processor unit 81 sends signals to the conduit switch means v1 to close the branch pipe T5*a* and to the conduit switch means v2 signals to open the branch pipe T5*b* while keeping the conduit switch means v3 opened. When the measurement is finished, the processing unit 81 sends signals to the conduit switch means v1 to open the branch pipe T5*a*, to the conduit switch means v2 signals to close the branch pipe T5*b* while keeping the conduit switch means v3 opened.

Then the processing unit 81 sends drive signals to the suction means 72 to be driven with a predetermined drive amount.

The processing unit 81 sends drive signals of the rotary type tabletting machine 41 to synchronously rotate the turntable 44, the upper punches 42 . . . and the lower punches 43 . . . at a fixed rotational speed.

Further the processing unit 81 sends drive signals to the air source 22 to be driven at a predetermined drive amount.

Drive signals are sent to the rotary drive means 25 of the pulsating vibration air conversion means 23 from the processing unit 81 so that the rotary drive means 25 is driven with a predetermined drive amount.

Then a predetermined positive pulsating vibration air is fed to the conduit T from the pulsating vibration air conversion means 23, further fed to the dispersion chamber 33 from the positive pulsating vibration air supply port 33*e*1, and becomes a swirling flow toward the discharge port 33*e*2 in the dispersion chamber 33.

When the positive pulsating vibration air is fed to the dispersion chamber 33, the elastic membrane 32 is repeatedly vibrated up and down (see FIG. 12*a*, FIG. 12*b* and FIG. 12*c*), therefore the lubricant (powder) stored and piled on the elastic membrane 32 in the lower cylindrical body 31*p*2 is discharged to the dispersion chamber 33 via the penetrating aperture 32*a* of the elastic membrane 32.

The discharge of the lubricant (powder) stored on the elastic membrane 32 is executed from the aperture 32*a* while the powder material spraying device 1 is operated by driving the pulsating vibration air generation means 21. When the amount (height H) of lubricant stored on the elastic membrane 32 becomes lower than the position (height Hth) where the level sensor 36 is provided (H<Hth), the light emitted from the light emitting element 36*a* is received by the light receiving element 36*b* so that the material feed valve 34 goes down to discharge the lubricant (powder) stored in the material storage hopper 2 onto the elastic membrane 32 in the lower cylindrical body 31*p*2. Thus the lubricant is discharged on the elastic membrane 32, the amount (height H) of the stored lubricant on the membrane 32 reaches the position (height Hth) where the level sensor 36 is positioned, and the light receiving element 36*b* doesn't receive the light emitted from the light emitting element 36*a*. The material feed valve 34 moves upward to stop discharging the material from the powdered material storage hopper 2 to the lower cylindrical body 31*p*2. Repeating such operations, approximately a fixed amount of lubricant (powder) is always stored on the elastic membrane 32 in the lower cylindrical body 31*p*2 while driving the powder material spraying device 1 by the pulsating vibration air generation means 21.

The lubricant (powder) discharged in the dispersion chamber 33 is mixed with and dispersed in the positive pulsating vibration air swirling in the chamber 33 to be fluidized and is discharged to the conduit T2 from the discharge port 33*e*2 together with the positive pulsating vibration air.

Aggregated particles with a large diameter in the lubricant (powder) keep swirling in the lower part of the dispersion chamber 33 so that such large particles of lubricant can't be discharged in the conduit T2.

Almost all of the large particles are caught in the positive pulsating vibration air to be pulverized into a predetermined particle size while swirling in the lower part of the dispersion chamber 33, then are discharged in the conduit T2, so that the lubricant (powder) with large particle size rarely deposits the dispersion chamber 33.

The lubricant (powder) discharged in the conduit T2 is pneumatically transported by the positive pulsating vibration air from the end e2 of the conduit T2 to the lubricant spraying chamber 61 to be sprayed together with the positive pulsating vibration air.

The lubricant (powder) supplied in the lubricant spraying chamber 61 is sprayed on each surface of the upper punches 42 . . . , the lower punches 43 . . . , and the dies 45 . . . contained therein.

The surplus lubricant (powder) sprayed in the lubricant spraying chamber 61 is sucked to be removed therefrom via the suction duct T5.

Therefore, a lubricant (powder) is sequentially and uniformly applied on each surface of the upper punches 42 . . . , the lower punches 43 . . . , and the dies 45 . . . at the lubricant spraying point R1.

Then a molding material is sequentially filled in the cavity formed by the die 45 and the lower punch 43 inserted in a fixed position in the die 45 by means of the feed shoe 48 at the material filling point R2.

The molding material filled in the die 45 is scraped to be a predetermined amount by the scraper 47 and is fed to a preliminary tabletting point R3 to be preliminary tabletted by the upper punch 42 and the corresponding lower punch 43. Then at a main tabletting point P4 the pre-tabletted molding material is fully compressed by the upper punch 42 and the lower punch 43 to produce a tablet t.

Thus produced tablet is then fed to the material discharge point R5 and is discharged to a discharge chute 49 by the tablet discharging scraper.

An operator observes the tablet t discharged in the discharge chute 49.

If sticking, capping or laminating is appeared in the tablets t . . . , the concentration of the lubricant (powder) in the lubricant spraying chamber 61 is controlled to be increased so as to reduce the frequency of such tablet problems. It can be achieved by controlling the drive amount of compression air source 22 or the suction means 72, by controlling the flow rate control means 24 if it is provided, or by controlling the pressure regulating valve 30 if it is provided for the pressure regulating port 26*c*. Furthermore, the elastic membrane 32 may be exchanged for the one with a larger penetrating aperture 32*a* for its purpose.

Consequently, the external lubrication type tabletting machine A can constantly produce a large amount of external lubrication tablets at a high industrial productivity, which has been difficult in prior arts.

On the other hand, when the lubricant amount in the tablet composition is found to be larger than the predetermined amount by analyzing the composition in the tablets t . . . even if tabletting problems such as sticking, capping and laminating aren't caused for the produced tablet t . . . , the concentration of the lubricant (powder) in the lubricant spraying chamber 61 is controlled to be reduced. It can be achieved by controlling the drive amount of compression air source 22 or suction means 72, by controlling the flow rate control means 24 if it is provided, or by controlling the pressure regulating valve 30 if it is provided for the pressure regulating port 26*c*. Consequently the amount of lubricant (powder) applied on each surface of the upper punch 42 . . . , the lower punch 43 . . . , and the dies 45 . . . is controlled to be constant so that the transposed amount of lubricant on those surfaces becomes constant. Furthermore, the elastic membrane 32 may be exchanged for the one with a smaller penetrating aperture 32*a* for the purpose.

The amount of lubricant (powder) dispersed on each surface of the tablets t . . . affects its disintegrability in case of external lubrication tablets.

External lubrication tablets have an advantage that the disintegration velocity of the tablets can be increased comparing with inner lubrication tablets (tablets produced by the molding material combined and dispersed with a lubricant (powder) in advance in order to prevent tabletting problems such as sticking, capping and laminating in case of tabletting procedure). However, if a large amount of lubricant (powder) is attached on the surface of the external lubrication tablet, the disintegration velocity of the tablets t . . . tends to be slow on account of the water repellency of the lubricant. According to the external lubrication type tabletting machine A, since the concentration of the lubricant (powder) in the lubricant spraying chamber 61 can be controlled at a desired degree, a large amount of external lubrication tablets with a superior disintegration property can be produced constantly at an industrial production basis while preventing tabletting problems such as sticking, capping and laminating.

Finishing such control operations, the above-mentioned production conditions are stored in the memory of the processing unit 81 of the external lubrication type tabletting machine A.

According to the external lubrication type tabletting machine A, the elastic membrane 32 doesn't go slack when the powder material spraying device 1 is operated for a long time because the elastic membrane installation means 5 is used for attaching the elastic membrane 32 to the spraying device 1.

Therefore, the production conditions of the tablets are stored in the memory of the processing unit 81 of the external lubrication type tabletting machine A, desired external lubrication tablets can be constantly produced for a long time according to the stored production conditions.

In the external lubrication tabletting machine A, the concentration of the lubricant (powder) in the lubricant spraying chamber 72 can be controlled by monitoring the lubricant passing through the measurement cell 74 by means of the light permeable type powder concentration measuring means 73 while producing tablets t. Further according to the external lubrication type tabletting machine A, the pulsating vibration air generation means 21, the powder material spraying device 1, the tabletting machine 41 and the suction means 72 aren't required to be stopped when the affection (noise) of the lubricant adhered on the measurement cell 74 is measured, so that there is an effect that tablets are produced at high productivity.

Figure 15:
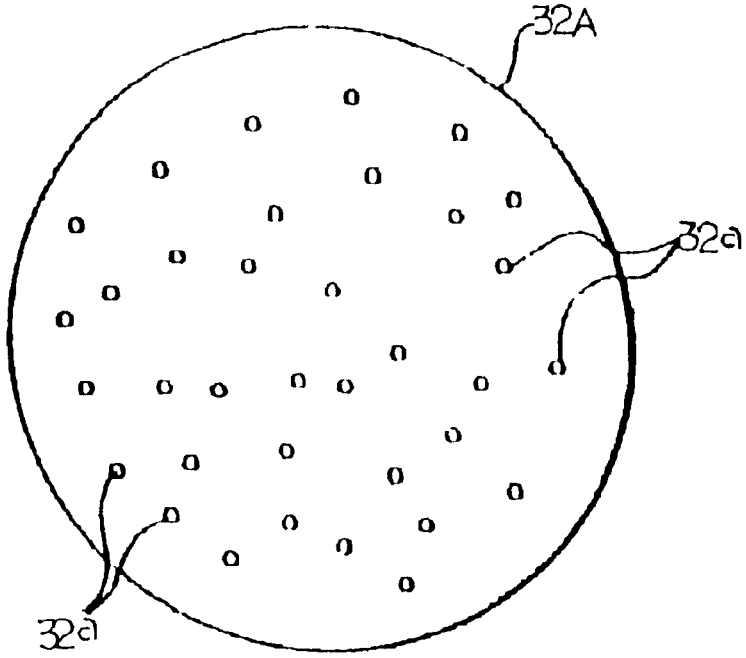
FIG. 15 is a plane view diagrammatically showing other embodiment of an elastic membrane used for the powdered material spraying device of the present invention.

In the above-mentioned embodiments, the elastic membrane 32 is explained to have one slit as a penetrating aperture 32*a*. However the number isn't limited and an elastic membrane 32A may have plural penetrating apertures 32*a* . . . as shown in FIG. 15.

Further according to the above-mentioned embodiments, the pulsating vibration air conversion means 23 comprising the pulsating vibration air generation means 21 is explained such that the valve plug 28 is moved up and down by rotating the cam 29 according to the concavo-convex pattern provided thereon and a desired positive pulsating vibration air is supplied in the conduit T1 by opening and closing the valve seat 27 by the valve plug 28. It is only a preferable example for accurately supplying a desired positive pulsating vibration air in the conduit T1. For example the rotary type pulsating vibration air conversion means 23A as shown in FIG. 16 and the rotary type pulsating vibration air conversion means 23B as shown in FIG. 17 may be provided.

Figure 16:
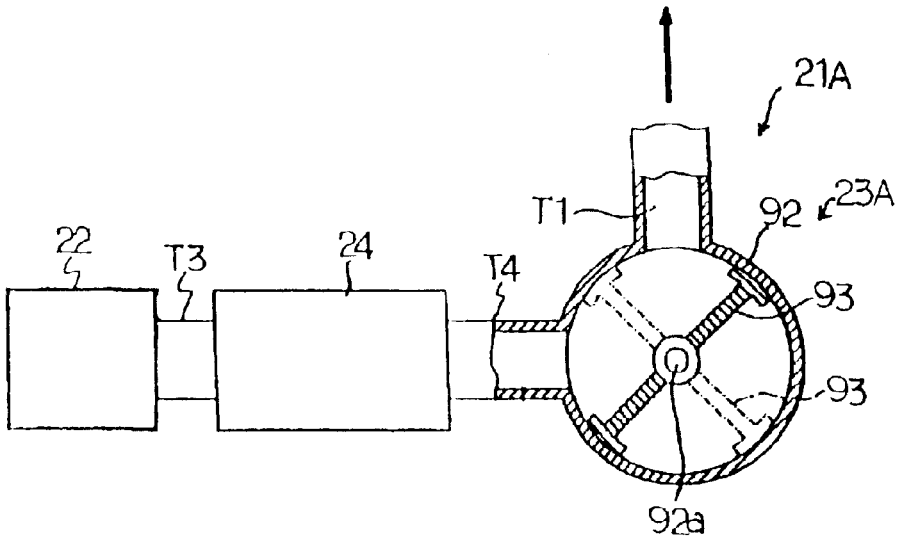
FIG. 16 is an explanatory view showing other embodiment of pulsating vibration air generation means used for the powdered material spraying device of the present invention.
Figure 17:
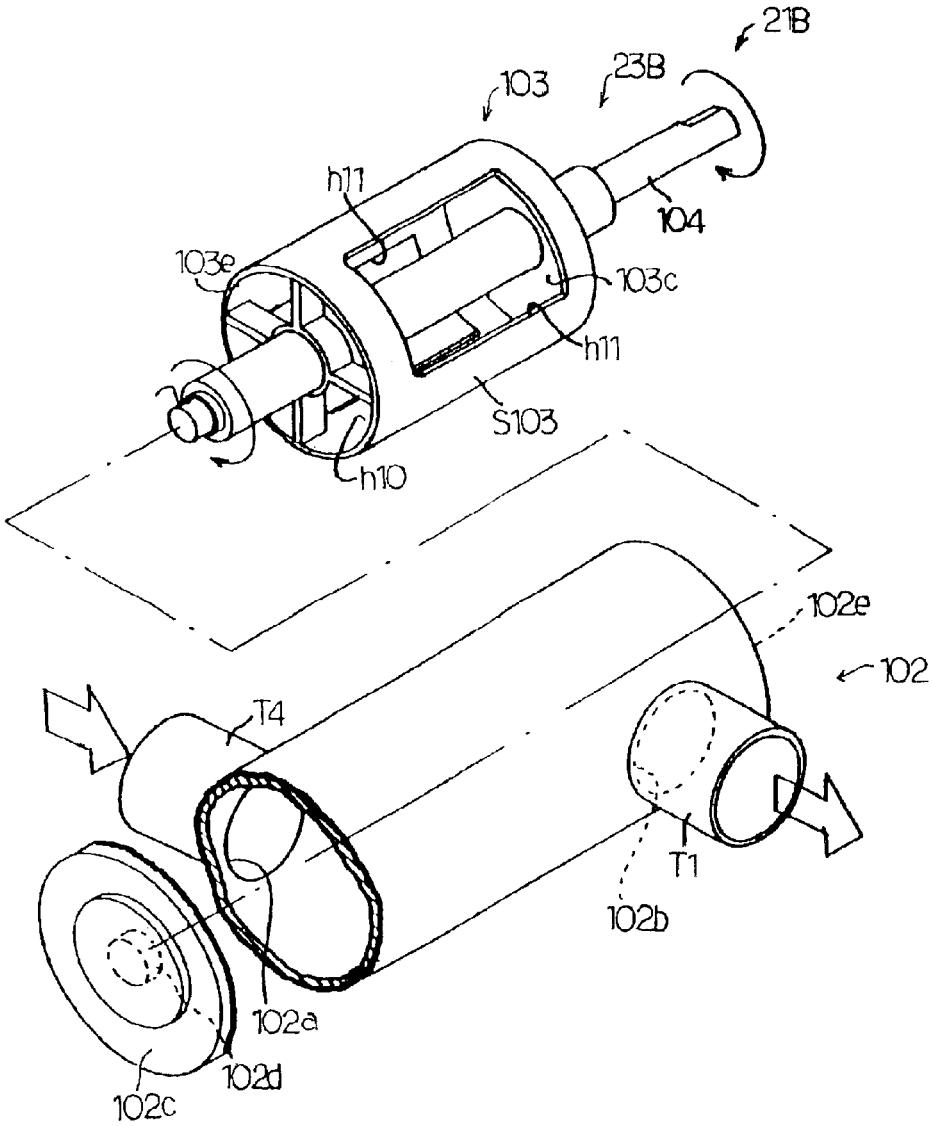
FIG. 17 is an explanatory view showing still other embodiment of pulsating vibration air generation means used for the powdered material spraying device of the present invention.

The pulsating vibration air generation means 21A of FIG. 16 has the same construction as the pulsating vibration air generation means 21 of FIG. 10 other than the construction of the pulsating vibration air conversion means. Corresponding members have the corresponding reference numerals and their explanations are omitted here.

The pulsating vibration air conversion means 23A of the pulsating vibration air generation means 21A has a cylindrical body 92 and a rotary valve 93 attached to a rotary axis 92*a* consisting a center axis of the cylindrical body 92 so as to divide a hollow chamber 93 into two parts. The rotary axis 92*a* is designed to be rotated at a fixed rotational speed by rotary drive means such as a motor (not shown).

Conduits T4 and T1 are connected to the external circumferential wall of the cylindrical body 92 with a fixed space.

A compression air source 22 is driven to supply a fixed amount of compressed air in a conduit T3 for supplying a desired positive pulsating vibration air in the conduit T1 by means of the pulsating vibration air generation means 21A. If flow rate control means 24 is provided, the flow rate of the compressed air fed in the conduit T4 is controlled by adjusting the flow rate control means 24.

The rotary axis 92*a* is rotated at a fixed rotational speed by rotary driving means such as an electric motor (not shown) so that the rotary valve 93 attached to the axis 92*a* is rotated at a fixed speed.

Then the compressed air generated from the compression air source 22 is fed to the conduit T1 from the conduit T4 because the conduits T4 and t1 are communicated when the rotary valve 93 is at a position shown with solid lines in the figure.

When the rotary valve 93 is positioned as shown in imaginary lines, the conduits T4 and T1 are shut of f by the rotary valve 93.

In such a case the compressed air is fed from the conduit T4 to one space S1 divided by the rotary valve 93 and air is compressed in the space S1.

On the other hand, the compressed air stored in another space S2 formed by the rotary valve 93 is fed to the conduit T1.

Repeating such operations by the rotation of the rotary valve 93, a positive pulsating vibration air is transmitted to the conduit T1.

Next, the pulsating vibration air generation means 21B in FIG. 17 is explained diagrammatically.

FIG. 17 shows an explanatory view diagrammatically showing the pulsating vibration air generation means 21B.

The pulsating vibration air generation means 21B in FIG. 17 has the same construction as the pulsating vibration air generation means 21 in FIG. 10 except for the construction of the pulsating vibration air conversion means 23B. The corresponding members have the same reference numerals and their explanations are omitted here.

The pulsating vibration air conversion means 23B of the pulsating vibration air generation means 21B has a cylindrical body 102 including a rotary valve 103.

The cylindrical body 102 is constructed such that one end 102*e* is opened and the other end is closed by a cover 102*c* and a suction port 102*a* and a transmission port 102*b* are provided for its circumferential side wall.

A conduit T4 is connected to the suction port 102*a* which is connected to the air source 22 and a conduit T1 is connected to the transmission port 102*b* which is connected to the powdered material quantitative feeder 1.

The member shown as 102*d* is a bearing hole for pivoting the rotary valve 103.

The rotary valve 103 is cylindrical with a hollow h10 and an opening h11 is provided on its circumferential wall S103. One end of the rotary valve 103 is opened and the other end is closed by a cover 103*c*.

A rotary axis 104 is extended to the rotary center of the rotary valve 103. Rotary drive means such as an electric motor (not shown) is connected to the rotary axis 104 and the rotary valve 103 is rotated around the rotary axis 104 when the rotary drive means is driven.

The outer diameter of the circumferential wall S103 of the rotary valve 103 is almost the same as the inner diameter of the cylindrical body 102 in such a manner that the rotary valve 103 is contained in the cylindrical body 102 so that the circumferential wall S103 rubs against the inner circumference of the body 102 when the rotary valve 103 is rotated.

The member shown as 103*d* in FIG. 17 is a rotary axis rotatably contained in the rotary bearing hole 102*d* provided for the cover 102*c* of the cylindrical body 102.

The rotary valve 103 is rotatably provided in the cylindrical body 102 such that the rotary axis 103*d* is attached to the rotary bearing hole 102*d*.

When a desired positive pulsating vibration air is supplied in the conduit T1 by means of the pulsating vibration air generation means 21B, a compressed air is supplied in the conduit T1 by driving the air source 22.

The rotary valve 103 can be rotated at a fixed rotational speed by rotating the rotary axis 104 at a fixed rotational speed by the rotary drive means such as an electric motor (not shown).

When the opening h11 of the rotary valve 103 is positioned at the transmission port 102*b*, the conduits T4 and T1 are communicated so that a compressed air is fed to the conduit pipe T1.

When the circumferential wall S103 of the rotary valve 103 is positioned at the transmission port 102*b*, the conduits T4 and T1 are closed by the wall S103 so that a compressed air isn't fed to the conduit T1.

Repeating such operations by the rotation of the rotary valve 103, a positive pulsating vibration air is fed in the conduit T1.

Considering the decrescence property of a positive pulsating vibration air, it is preferable to produce a positive pulsating vibration air with clear on and off conditions from the pulsating vibration air generation means. In order to generate such a clear positive pulsating vibration air, it is preferable to use the rotary cam type pulsating vibration air conversion means 23 in FIG. 10 rather than the rotary type pulsating vibration air conversion means 23A in FIG. 16 and the rotary type pulsating vibration air conversion means 23B in FIG. 17.

In the above-mentioned powder material spraying device 1, an example is explained wherein a lubricant (powder) is stored in the material storage hopper 2. However, the material spraying device 1 isn't limited for a lubricant spraying chamber but can be used as a quantitative feeder of several kinds of powder.

For example, the powder material spraying device 1 may be provided around a metal mold of an injection molding machine and can be preferably used as molding lubricant spraying device for an injection mold. An injection molding cycle is comprised of a nozzle touch procedure, an injection procedure for injecting a melted resin in a clamped mold, a cooling procedure for cooling down the melted resin injected in the mold and a take-out procedure for taking out the molded resin by opening the mold. At the take-out procedure a spraying port e2 is approached to the clamped area of a movable mold and a fixed mold by means of a robot and so on immediately after the molded resin is taken out, and then a molding lubricant (powder) is sprayed on the movable mold surface and the fixed mold surface in order to prevent the molded resin from adhering on the molding surfaces. Thereafter, the spraying port e2 is moved out of the clamp area.

If several kinds of powder such as food, resin, chemical materials are contained in the powdered material storage hopper 2 of the powder material spraying device 1, the spraying device 1 can be used as a quantitative feeder for such a powder.

Next, the effects of the powder material spraying device 1 of the present invention are explained based on experiments.

The experiments were executed as follows.

The powder material spraying device 1 shown in FIG. 1 was composed.

A bypass pipe 35 was detachably provided for a cylindrical body 31 and a dispersion chamber 33.

When the bypass pipe 35 was removed from the cylindrical body 31 and the dispersion chamber 33, a connecting hole 31*h* of the bypass pipe 35 of the cylindrical body 31 was able to be closed by a cover (not shown) and a connecting hole 33*h* of the bypass pipe 35 of the dispersion chamber 33 was able to be also covered by a cover (not shown).

A conduit with a fixed length (not shown) was connected to a discharge port 33*e*2 of the dispersion chamber 33 and light permeable type powder concentration measuring means was connected to the tip of the conduit.

Pulsating vibration air generation means 21 shown in FIG. 10 was connected to a pulsating vibration air supply port 33*e*1 of the dispersion chamber 33 of the powder material spraying device 1.

Next, magnesium stearate powder (Japanese Pharmacopoeia) was contained as a lubricant in the storage hopper 2, then a cover 2*c* was airtightly attached to a material feed port 2*b* of the hopper 2.

A level sensor 36 was operated and a fixed amount of magnesium stearate powder was placed on an elastic membrane 32 in a cylindrical body 31.

A positive pulsating vibration air with a predetermined frequency (20 Hz in this example) and at a fixed pressure (0.2 Mpa in this example) was supplied to the dispersion chamber 33 by driving the pulsating vibration air generation means 21. The spray amount of magnesium stearate powder (Japanese Pharmacoapoeia) sprayed from the tip of a conduit (not shown) connected to the discharge port 33*e*2 of the dispersion chamber 33 was measured with time.

Next, the bypass pipe 35 was removed from the powder material spraying device 1, the connecting hole 31*h* (not shown) of the cylindrical body 31 to the bypass pipe 35 was closed by the cover and the connecting hole 33*h* of the dispersion chamber 33 to the bypass pipe 35 was closed by the cover (not shown). Under such conditions other conditions were the same as the above-mentioned, the spray amount of magnesium stearate powder (Japanese Pharmacopoeia) from the tip of the conduit (not shown) connected to the discharge port 33*e*2 of the dispersion chamber 33 was measured with time.

Figure 18:
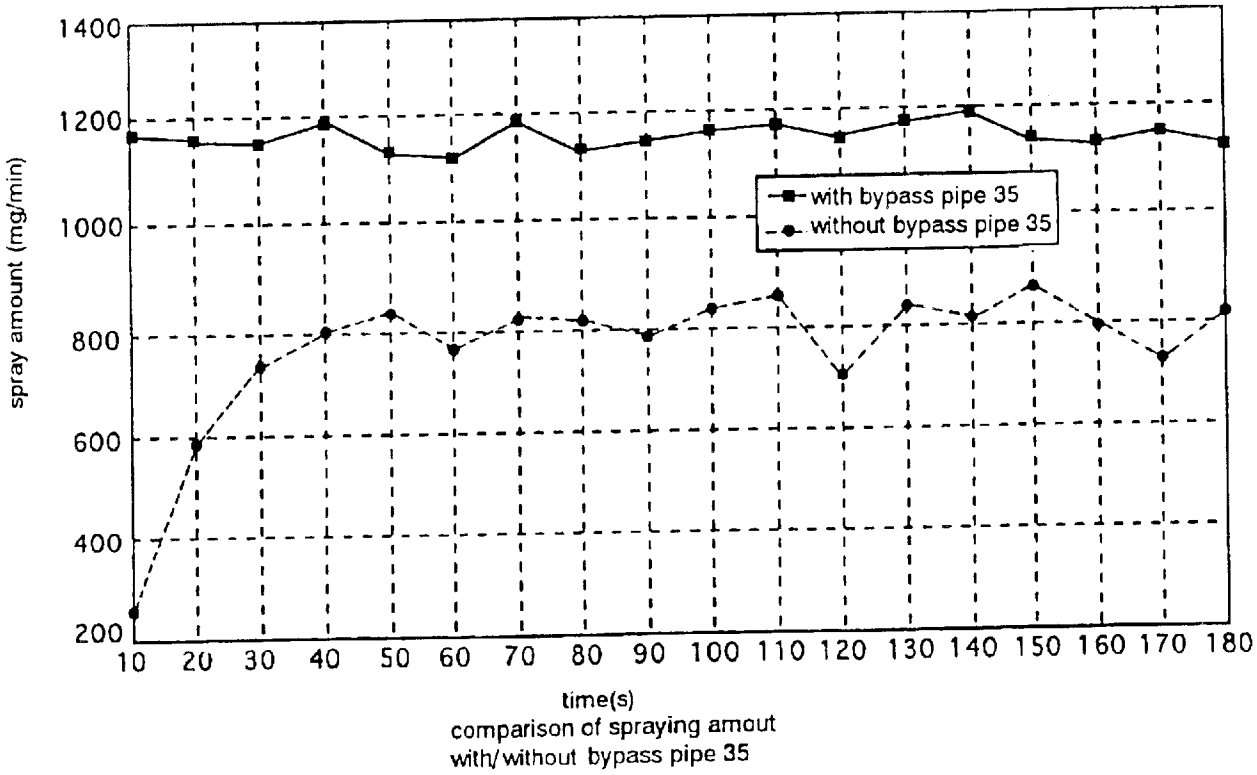
FIG. 18 is a graph showing quantitative test results with time according to a powdered material spraying device of the present invention.

The result is shown in FIG. 18.

A sequential line graph shown with a solid line in FIG. 1 shows the variation per hour of the spray amount of magnesium stearate powder (Japanese Pharmacopoeia) from the tip of the conduit (not shown) connected to the discharge port 33*e*2 of the dispersion chamber 33 of the powder material spraying device 1 when the bypass pipe 35 was attached. A sequential line graph shown with a dotted line shows that when the bypass pipe was removed.

A comparison is made between the spray amount of magnesium stearate powder (Japanese Pharmacopoeia) from the tip of the conduit (not shown) connected to the discharge port 33*e*2 of the dispersion chamber 33 of the powder material spraying device 1 when the bypass pipe 35 is attached and that when the bypass pipe 35 is removed. As seen from FIG. 18, a fixed amount of magnesium stearate is sprayed at almost a steady rate immediately after the powder material spraying device 1 attaching the bypass pipe 35 is driven. Such a spraying device is superior to the one without having the bypass pipe 35 considering the economic stability and quantitativeness. Further it has been found that a larger amount of magnesium stearate powder can be sprayed per hour from the tip of the conduit (not shown) connected to the discharge port 33*e*2 of the dispersion chamber 33 with a smaller energy.

INDUSTRIAL APPLICABILITY

As mentioned above, the powdered material spraying device as set forth in claim 1 has two air communication passages: an aperture of an elastic membrane and a bypass pipe, by connecting the bypass pipe between a cylindrical body and a dispersion chamber.

Therefore, the air can flow in an available passage between the cylindrical body and the dispersion chamber because there are two air communication passages.

When a positive pulsating vibration air is supplied to the dispersion chamber, the pressure in the cylindrical body and the pressure in the dispersion chamber are instantly balanced, so that the elastic membrane is vibrated up and down with almost equal amplitudes against the vibration of the positive pulsating vibration air with its original stretched position at a neutral position, thereby achieving the superior reproductivity and responsibility. As a result, a powdered material can be discharged well via the penetrating aperture of the elastic membrane.

According to the elastic membrane installation means as set forth in claim 2, an elastic membrane is placed on a push-up member on a pedestal and a presser member is fastened to the pedestal, so that the elastic membrane is pushed up into a direction of the presser member by means of the push-up means. As a result, the elastic membrane is stretched from its inside to outside by being pushed up into the presser member direction.

The stretched elastic membrane is at first inserted between a V-groove provided on the surface of the pedestal and a V-shaped projection provided on the surface of the presser member facing the pedestal via a space between the periphery (inclined plane) of the push-up member and the surface (inner circumference) forming a hollow of the presser member.

The presser member is further tightened to the pedestal and is held between the periphery (inclined plane) of the push-up member and the surface comprising the hollow of the presser member while being pushed up into a direction of the presser member. Simultaneously, the elastic membrane is extended from its center to its periphery by being pushed up by the push-up member and the inserted part between the V-groove on the pedestal and the V-shaped projection of the presser member is held therebetween.

Accordingly, the elastic membrane can be stretched only by a simple operation that it is placed on the push-up member on the pedestal and the presser member is tightened against the pedestal.

According to the elastic membrane installation means described in claim 3, an inclined plane extending from top to bottom seen in section is provided at the periphery of the push-up member. The extended part from the center to the periphery of the elastic membrane by being pushed into a direction of the presser member is easily inserted between the annular V-groove on the pedestal and the annular V-shaped projection on the part of presser member facing the pedestal.

Also according to the above-mentioned, the elastic membrane can be stretched only by a simple operation that the elastic membrane is placed on the push-up member on the pedestal and the presser member is tightened against the pedestal.

Furthermore, when the presser member is tightened to the pedestal, the space between the inclined plane at the periphery of the push-up member and the inner circumference of the hollow of the presser member gradually becomes narrow, so that the elastic member is firmly held therebetween. Therefore, the elastic membrane doesn't go slack after the presser member is tightened against the pedestal.

Consequently, if the elastic membrane is stretched by means of the elastic membrane installation means for installing a diaphragm on an instrument or an elastic membrane is installed in a powdered material spraying device, accurate operations of the instrument can be kept for a long time because the elastic membrane doesn't go slack.

According to the powdered material spraying device as set forth in claim 4, a positive pulsating vibration air is introduced from a tangential direction at a lower part of the dispersion chamber and is discharged into a tangential direction at an upper part of the chamber, so that the positive pulsating vibration air swirls from bottom to top in the dispersion chamber.

The dispersion chamber has the same function as a cyclone by the positive pulsating vibration air swirling in the chamber.

Therefore, even if aggregated large particles of the powdered material are discharged in the dispersion chamber from a penetrating aperture of the elastic membrane, such a material swirls in the bottom of the chamber so as not to be sprayed from the end of the conduit.

Accordingly, a fixed amount of powdered material with uniform particle size can be sprayed from the end of the conduit when such a powdered material spraying device is applied.

The aggregated large particles of the powdered material are pulverized into small particles by being caught in the swirling positive pulsating vibration air. Thus pulverized powdered material into predetermined particle size is discharged out of the dispersion chamber, so that the aggregated large particles rarely deposit in the dispersion chamber.

What is claimed is:

1. A powdered material spraying device, comprising:

a powdered material storage hopper for storing a powdered material, said storage hopper having a material discharge port and a material feed port, said material feed port bearing an airtight, detachable cover;

a quantitative spraying device provided for said material discharge port of said powdered material storage hopper via a material feed valve;

said quantitative spraying device comprising (A) a cylindrical body with openings at the top and the end respectively, said cylindrical body being airtightly connected with said material discharge port of said powdered material storage hopper, (B) an elastic membrane with a penetrating aperture provided so as to form a bottom of said cylindrical body at its lower opening end, and (C) a dispersion chamber connected under said lower opening end of said cylindrical body via said elastic membrane, said dispersion chamber comprising (i) a pulsating vibration air supply port for supplying a positive pulsating vibration air to said dispersion chamber, and (ii) a discharge port connected with a conduit for pneumatically transporting powdered material to a desired place by means of the positive pulsating vibration air, said powdered material being discharged into said dispersion chamber via said penetrating aperture when said elastic membrane is vibrated up and down by the positive pulsating vibration air supplied in said dispersion chamber from said pulsating vibration air supply port and being dispersed by the positive pulsating vibration air supplied in said dispersion chamber; and a bypass pipe connected between said cylindrical body and said dispersion chamber through which air moves freely between said cylindrical body and said dispersion chamber during spraying operation, so as to equalize air pressure between said cylindrical body and said dispersion chamber, wherein said pulsating vibration air supply port is provided at a lower part of said dispersion chamber in a substantially tangential direction against an internal circumference of said dispersion chamber; said discharge port being provided at an upper part of said dispersion chamber in a substantially tangential direction against the internal circumference of said dispersion chamber.

2. A powdered material spraying device, comprising:

a powdered material storage hopper for storing a powdered material, said storage hopper having a material discharge port and a material feed port, said material feed port bearing an airtight, detachable cover;

a quantitative spraying device provided for said material discharge port of said powdered material storage hopper via a material feed valve;

said quantitative spraying device comprising (A) a cylindrical body with openings at the top and the end respectively, said cylindrical body being airtightly connected with said material discharge port of said powdered material storage hopper, (B) an elastic membrane with a penetrating aperture provided so as to form a bottom of said cylindrical body at its lower opening end, and (C) a dispersion chamber connected under said lower opening end of said cylindrical body via said elastic membrane, said dispersion chamber comprising (i) a pulsating vibration air supply port for supplying a positive pulsating vibration air to said dispersion chamber, and (ii) a discharge port connected with a conduit for pneumatically transporting powdered material to a desired place by means of the positive pulsating vibration air, said powdered material being discharged into said dispersion chamber via said penetrating aperture when said elastic membrane is vibrated up and down by the positive pulsating vibration air supplied in said dispersion chamber from said pulsating vibration air supply port and being dispersed by the positive pulsating vibration air supplied in said dispersion chamber; and a bypass pipe connected between said cylindrical body and said dispersion chamber through which air moves freely between said cylindrical body and said dispersion chamber during spraying operation, so as to equalize air pressure between said cylindrical body and said dispersion chamber, wherein said elastic membrane is provided by means of an elastic membrane installation device between a lower part of said cylindrical body and an upper part of said dispersion chamber, said elastic membrane installation device comprising a pedestal with a hollow part; a push-up member with a hollow part provided so as to rise on a surface of said pedestal; and a presser member with a hollow part, said presser member being a little larger than an outer circumference of said push-up member;

said pedestal having a V-groove outside of its hollow to be outside of the outer circumference of said push-up member so as to annularly surround the hollow of said pedestal;

said presser member having an annular V-shaped projection on its surface facing said pedestal so as to be incorporated with said V-groove provided on the surface of said pedestal;

said push-up member being placed on the surface of said pedestal, said elastic membrane being placed on said push-up member and said presser member being fastened against said pedestal so as to cover both said push-up member and said elastic membrane said elastic membrane being maintained to extend from its center to its periphery by pushing up said elastic membrane into said presser member by means of said push-up member;

a periphery of said elastic membrane extended by said push-up member being held between the periphery of said push-up member and a plane forming the hollow of said presser member, said V-groove and said V-shaped projection;

a bottom of said pedestal being provided above said dispersion chamber; and a top of said presser member being provided under said cylindrical body.

3. The powdered material spraying device as set forth in claim 2, wherein said push-up member has an inclined plane extending from top to bottom at its periphery when viewed in section.

4. The powdered material spraying device as set forth in either of claims 2 or 3, wherein said pulsating vibration air supply port is provided at a lower part of said dispersion chamber in a substantially tangential direction against an internal circumference of said dispersion chamber; said discharge port being provided at an upper part of said dispersion chamber in a substantially tangetial direction against the internal circumference of said dispersion chamber.

5. A powdered material spraying device, comprising:

a powdered material storage hopper for storing a powdered material, a quantitative spraying device provided for a material discharge port of said powdered material storage hopper via a material feed valve, a cover being detachably and airtightly provided for said material feed port of said powdered material storage hopper;

said quantitative spraying device comprising, a cylindrical body with openings at the top and the end respectively, said cylindrical body being airtightly connected with said material discharge port of said powdered material storage hopper, an elastic membrane with a penetrating aperture provided so as to form a bottom of said cylindrical body at its lower opening end, and a dispersion chamber connected under said lower opening end of said cylindrical body via said elastic membrane;

said dispersion chamber comprising a pulsating vibration air supply port for supplying a positive pulsating vibration air to said dispersion chamber, and a discharge port connected with a conduit for pneumatically transporting powdered material to a desired place by means of the positive pulsating vibration air, said powdered material being discharged into said dispersion chamber via said penetrating aperture when said elastic membrane is vibrated up and down by the positive pulsating vibration air supplied in said dispersion chamber from said pulsating vibration air supply port and being dispersed by the positive pulsating vibration air supplied in said dispersion chamber; and a bypass pipe connected between said cylindrical body and said dispersion chamber, wherein said elastic membrane is provided by means of an elastic membrane installation device between a lower of said cylindrical body and an upper part of said dispersion chamber, said elastic membrane installation device comprising a pedestal with a hollow part; a push-up member with a hollow part provided so as to rise on a surface of said pedestal; and a presser member with a hollow part, said presser member being a little larger than an outer circumference of said push-up member;

said pedestal having a V-groove outside of its hollow to be outside of the outer circumference of said push-up member so as to annularly surround the hollow of said pedestal;

said presser member having an annular V-shaped projection on its surface facing said pedestal so as to be incorporated with said V-groove provided on the surface of said pedestal;

said push-up member being placed on the surface of said pedestal, said elastic membrane being placed on said push-up member and said presser member being fastened against said pedestal so as to cover both said push-up member and said elastic membrane said elastic membrane being prevented to be extended from its center to its periphery by pushing up said elastic membrane into said presser member by means of said push-up member;

a periphery of said elastic membrane extended by said push-up member being held between the periphery of said push-up member and a plane forming the hollow of said presser member, said V-groove and said V-shaped projection;

a bottom of said pedestal being provided above said dispersion chamber; and a top of said presser member being provided under said cylindrical body.

6. The powdered material spraying device as set forth in claim 5, wherein said push-up member has an inclined plane extending from top to bottom at its periphery when viewed in section.

7. The powdered material spraying device as set forth in claim 5 or 6, wherein said pulsating vibration air supply port is provided at a lower part of said dispersion chamber in a substantially tangential direction against an internal circumference of said dispersion chamber; said discharge port being provided at an upper part of said dispersion chamber in a substantially tangetial direction against the internal circumference of said dispersion chamber.

8. A powdered material spraying device, comprising:

a powdered material storage hopper for storing a powdered material, a quantitative spraying device provided for a material discharge port of said powdered material storage hopper via a material feed valve, a cover being detachably and airtightly provided for said material feed port of said powdered material storage hopper;

said quantitative spraying device comprising, a cylindrical body with openings at the top and the end respectively, said cylindrical body being airtightly connected with said material discharge port of said powdered material storage hopper, an elastic membrane with a penetrating aperture provided so as to form a bottom of said cylindrical body at its lower opening end, and a dispersion chamber connected under said lower opening end of said cylindrical body via said elastic membrane;

said dispersion chamber comprising a pulsating vibration air supply port for supplying a positive pulsating vibration air to said dispersion chamber, and a discharge port connected with a conduit for pneumatically transporting powdered material to a desired place by means of the positive pulsating vibration air, said powdered material being discharged into said dispersion chamber via said penetrating aperture when said elastic membrane is vibrated up and down by the positive pulsating vibration air supplied in said dispersion chamber from said pulsating vibration air supply port and being dispersed by the positive pulsating vibration air supplied in said dispersion chamber; and a bypass pipe connected between said cylindrical body and said dispersion chamber, wherein said pulsating vibration air supply port is provided at a lower part of said dispersion chamber in a substantially tangential direction against an internal circumference of said dispersion chamber; said discharge port being provided at an upper part of said dispersion chamber in a substantially tangetial direction against the internal circumference of said dispersion chamber.

9. The powdered material spraying device as set forth in claim 8 wherein said elastic membrane is provided by means of an elastic membrane installation device between a lower of said cylindrical body and an upper part of said dispersion chamber, said elastic membrane installation device comprising a pedestal with a hollow part; a push-up member with a hollow part provided so as to rise on a surface of said pedestal; and a presser member with a hollow part, said presser member being a little larger than an outer circumference of said push-up member;

said pedestal having a V-groove outside of its hollow to be outside of the outer circumference of said push-up member so as to annularly surround the hollow of said pedestal;

said presser member having an annular V-shaped projection on its surface facing said pedestal so as to be incorporated with said V-groove provided on the surface of said pedestal;

said push-up member being placed on the surface of said pedestal, said elastic membrane being placed on said push-up member and said presser member being fastened against said pedestal so as to cover both said push-up member and said elastic membrane said elastic membrane being prevented to be extended from its center to its periphery by pushing up said elastic membrane into said presser member by means of said push-up member;

a periphery of said elastic membrane extended by said push-up member being held between the periphery of said push-up member and a plane forming the hollow of said presser member, said V-groove and said V-shaped projection;

a bottom of said pedestal being provided above said dispersion chamber; and a top of said presser member being provided under said cylindrical body.

10. The powdered material spraying device as set forth in claim 9, wherein said push-up member has an inclined plane extending from top to bottom at its periphery when viewed in section.

* * * * *

UNITED STATES PATENT AND TRADEMARK OFFICE

CERTIFICATE OF CORRECTION

PATENT NO. : 6,776,361 B1
DATED : August 17, 2004
INVENTOR(S) : Yasushi Watanabe et al.

It is certified that error appears in the above-identified patent and that said Letters Patent is hereby corrected as shown below:

Drawings,
Sheet 18, Figure 18, “amout” should read -- amount --.

Column 2,
Line 54, “However” should read -- However, --.

Column 3,
Line 42, “room of” should read -- room for --; and
Line 64, “60” should read -- so --.

Column 4,
Line 3, “includes;” should read -- includes: --.

Column 8,
Line 26, “spray device 1” should read -- spraying device 1 --.

Column 9,
Line 57, “litter” should read -- little --.

Column 13,
Line 51, “port 31e1” should read -- port 33e1 --.

Column 14,
Line 16, “spray” should read -- spraying --.

Column 15,
Line 10, “punches 42 plural” should read -- punches 42…, plural --.

Column 17,
Line 24, “mean” should read -- means --; and
Line 29, “concavo-convex” should read -- concavo-convex pattern --.

Column 18,
Line 1, “upto” should read -- up to --.

Column 20,
Line 39, “objected” should read -- intended --.

UNITED STATES PATENT AND TRADEMARK OFFICE

CERTIFICATE OF CORRECTION

PATENT NO. : 6,776,361 B1
DATED : August 17, 2004
INVENTOR(S) : Yasushi Watanabe et al.

It is certified that error appears in the above-identified patent and that said Letters Patent is hereby corrected as shown below:

Column 24,
Line 4, “cell 7.” should read -- cell 74. --.

Column 26,
Line 57, “deposits” should read -- deposits in --.

Column 27,
Line 25, “is appeared” should read -- appears --.

Column 29,
Line 21, “t1” should read -- T1 --; and
Line 26, “of f” should read -- off --.

Column 31,
Line 56, “FIG.1” should read -- FIG. 18 --.

Column 32,
Line 35, “as” should be deleted;
Line 36, “set forth in claim 2” should be deleted; and
Line 64, “described in claim 3” should be deleted.

Column 33,
Line 24, “as” should be deleted; and
Line 25, “set forth in claim 4” should be deleted.

Column 35,
Line 21, “membrane” should read -- membrane; --.

Column 36,
Line 17, “lower” should read -- lower part --;
Line 38, “membrane” should read -- membrane; --;
Line 39, “prevented to be extended” should read -- maintained to extend --; and
Line 63, “tangetial” should read -- tangential --.

Column 37,
Line 34, “tangetial” should read -- tangential --;
Line 38, “claim 8” should read -- claim 8, --; and
Line 39, “lower” should read -- lower part --.

UNITED STATES PATENT AND TRADEMARK OFFICE

CERTIFICATE OF CORRECTION

PATENT NO. : 6,776,361 B1
DATED : August 17, 2004
INVENTOR(S) : Yasushi Watanabe et al.

It is certified that error appears in the above-identified patent and that said Letters Patent is hereby corrected as shown below:

Column 38,
Line 21, “membrane” should read -- membrane; --; and
Line 22, “prevented to be extended” should read -- maintained to extend --.

Signed and Sealed this

Eighteenth Day of January, 2005

JON W. DUDAS
*Director of the United States Patent and Trademark Office*